US007604344B2

(12) United States Patent
Seki et al.

(10) Patent No.: US 7,604,344 B2
(45) Date of Patent: Oct. 20, 2009

(54) LIQUID APPLICATION DEVICE AND INKJET RECORDING APPARATUS

(75) Inventors: Satoshi Seki, Kawasaki (JP); Naoji Otsuka, Yokohama (JP); Kiichiro Takahashi, Kawasaki (JP); Osamu Iwasaki, Tokyo (JP); Minoru Teshigawara, Yokohama (JP); Tetsuya Edamura, Kawasaki (JP); Yoshinori Nakagawa, Kawasaki (JP); Naomi Oshio, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 461 days.

(21) Appl. No.: 11/275,999

(22) Filed: Feb. 9, 2006

(65) Prior Publication Data

US 2006/0176325 A1 Aug. 10, 2006

(30) Foreign Application Priority Data

Feb. 9, 2005 (JP) ..... 2005-033538

(51) Int. Cl.
*B41J 2/01* (2006.01)

(52) U.S. Cl. ..... 347/103; 347/101; 347/7

(58) Field of Classification Search ..... 347/101, 347/103, 7
See application file for complete search history.

(56) References Cited

U.S. PATENT DOCUMENTS 5,367,982 A * 11/1994 DeMoore et al. ..... 118/46
6,183,079 B1 * 2/2001 Meade et al. ..... 347/101
2005/0179720 A1 8/2005 Iwasaki et al.
2005/0212835 A1 * 9/2005 Konno ..... 347/6
2007/0034102 A1 2/2007 Oshio et al.
2007/0034152 A1 2/2007 Nakagawa et al.
2007/0035592 A1 2/2007 Oshio et al.
2007/0035593 A1 2/2007 Iwasaki et al.
2007/0070163 A1 3/2007 Masuyama et al.
2007/0126835 A1 6/2007 Oshio et al.
2007/0126836 A1 6/2007 Masuyama et al.

FOREIGN PATENT DOCUMENTS

JP 8-058069 3/1996
JP 8-072227 3/1996
JP 2001-070858 3/2001
JP 2002-096452 4/2002
JP 2002-517341 6/2002

* cited by examiner

*Primary Examiner*—Matthew Luu
*Assistant Examiner*—Henok Legesse
(74) *Attorney, Agent, or Firm*—Fitzpatrick, Cella, Harper & Scinto

(57) ABSTRACT

The present invention provides a liquid application device and an inkjet recording apparatus, which are capable of supplying liquid to a liquid room with the power consumption and/or the noise which are reduced. A pump is driven to fill a liquid retention space S with an application liquid. When the filling has been completed, the pump is stopped. Subsequently, the application liquid is applied to an application medium which has been transferred. At this time, a count in a RAM is increased. Thereafter, the determination as to whether or not the application can be carried out is made on the basis of the count and the prescribed application-performable number of sheets stored in a ROM. If it is determined that the application cannot be carried out, the filling of the application liquid is performed. If it is determined that the application can be carried out, next application is performed.

4 Claims, 29 Drawing Sheets

| SHEET SIZE | CONSUMPTION QUANTITIES TO BE ADDED |
|---|---|
| A3 | 8 |
| A4 | 4 |
| A5 | 2 |
| B5 | 3 |
| LETTER | 4 |

FIG.22

THRESHOLD TABLE

| ENVIRONMENTAL TEMPERATURE | THRESHOLD |
|---|---|
| $10^\circ C < T$ | 12 |
| $30^\circ C > T \geq 10^\circ C$ | 16 |
| $T \geq 30^\circ C$ | 20 |

FIG.25

LIQUID APPLICATION DEVICE AND INKJET RECORDING APPARATUS

BACKGROUND OF THE INVENTION

1. Field of the Invention

The present invention relates to a liquid application device and an inkjet recording apparatus, and particularly to a liquid application device for applying liquid to a medium for a certain purpose which is, for example, to promote the coagulation of pigment when recording is carried out using an ink which contains the pigment as a coloring material. The present invention also relates particularly to an inkjet recording apparatus which includes a mechanism for applying liquid to a recording medium used in inkjet recording, for a purpose which is, for example, to promote the coagulation of pigment when recording is carried out using an ink containing the pigment as a coloring material.

2. Description of the Related Art

As modes of widely applying liquid or liquid material to a medium, spin coaters, roll coaters, bar coaters, and die coaters are known. These application modes are adopted on the assumption that the application is consecutively performed to a relatively long application medium. As a result, when application media with a relatively small size are intermittently fed, and the application is performed to these media, the problem can occur that a uniform coating film cannot be obtained due to the irregularities of beads of coating material at the start or the end point of the application, for example.

As a configuration capable of solving such a problem, one which is described in Japanese Patent Application Laid-open No. 2001-070858 is known. This is a die-coater type, in which a rotating rod bar is used, and coating material is discharged from a discharging slit to the rod bar to form a coating film on the rod bar. The formed coating film is brought into contact with an application medium and is transferred thereto as the rod bar rotates. When the coating film formed on the rod bar is not transferred or applied to an application medium, the coating material returns into the head as the rod bar rotates, and the material is collected via a collection slit. In other words, even when the application is not carried out, the rod bar keeps rotating, and the coating material remains forming a coating film on the rod bar. In this way, it is made possible to obtain a uniform coating film even when the application media are intermittently supplied, and the application is intermittently performed thereto.

Among inkjet recording apparatuses, one which utilizes a liquid application mechanism is known. According to the description in Japanese Patent Application Laid-open No. 2002-517341, a doctor blade abutting a roller is used, coating liquid is stored between the blade and the roller, and the coating liquid is applied to the roller as the roller rotates. As the roller rotates, the applied coating liquid is transferred or applied to a base material transferred between this roller and another roller. Also in Japanese Patent Application Laid-open No. 8-072227 (1996), shown is a mechanism which previously applies a treatment liquid insolubilizing dyes before recording, in an inkjet recording apparatus. The description of the first example in this document discloses that the treatment liquid in a replenishing tank adheres to a rotating roller and is thus pumped, and, at the same time, the pumped treatment liquid is applied to a recording paper.

However, with regard to the configurations described in the above documents, Japanese Patent Application Laid-open No. 2001-70858, Japanese Patent Application Laid-open No. 2002-517341 and Japanese Patent Application Laid-open No. 8-72227 (1996), the rod bar or the roller rotates, and the application liquid is applied or supplied to the surface of the bar or the roller, in which the area where the application or supply is performed, is opened to or communicates with the atmosphere. For this reason, there arises the problem of vaporization of the application liquid. In addition, there is a possibility that the problem can occur that, when the position of the apparatus changes, this results in the leakage of the application liquid.

Among others, with regard to the inkjet recording apparatuses, such as printers, with the leakage of the liquid due to the position change at the time of carrying taken into consideration, it is difficult to apply the application mechanism described in the above documents to downsized apparatuses.

Meanwhile, in Japanese Patent Application Laid-open No. 8-058069 (1996), disclosed is a gravure printing machine having a configuration in which the area is sealed off where ink as the application liquid is applied or supplied to a roller which has a print pattern formed on the surface thereof. With regard to this apparatus, an ink chamber having two doctor blades is brought into contact with the circumferential surface of the roller to form a liquid room (an ink reservoir) between the chamber and the roller.

In the apparatus described in Japanese Patent Application Laid-open No. 8-58069 (1996), a pump is provided between an ink tank to store ink and the liquid room. The ink in the ink tank is pumped into the liquid room by the pump, so that the ink is supplied from the ink tank to the liquid room. In addition, the ink in the liquid room is sent to a receiving tank which receives the ink discharged from the liquid room.

In other words, the ink is supplied to the liquid room by the above pumping, and, at the same time, the roller is driven to rotate, while the chamber is allowed to abut on the circumferential surface of the roller. In this way, the ink is applied to the roller. Accordingly, the pump is continuously driven during the ink application operation, which results in the increase in the power consumption of the apparatus. In addition, the operating noise of the pump is always made during the application operation, causing the fear of the noise problem.

SUMMARY OF THE INVENTION

An object of the present invention is to provide a liquid application device and an inkjet recording apparatus, which are capable of supplying liquid to a liquid room with the power consumption and/or the noise which are reduced.

In one aspect of the present invention, a liquid application device comprises liquid application means comprising an application member for applying a liquid to a medium and a retention member that abuts against the application member so as to form a liquid retention space for retaining the liquid, wherein the liquid application means applies the liquid retained in the liquid retention space to the medium via the application member by rotating the application member; storage means for storing the liquid; first and second passages which allow the storage means and the retention member to communicate with each other; liquid moving means for causing the liquid to flow in a channel including the first passage, the liquid retention space, and the second passage; acquisition means for acquiring information concerning a consumption of the liquid consumed during the application; and control means for controlling whether or not a supply operation of the liquid from the storage means to the liquid retention space by the liquid moving means is performed, on the basis of the information concerning the consumption of the liquid acquired by the acquisition means.

Further, in other aspect of the present invention, a liquid application device comprises liquid application means comprising an application member for applying a liquid to a medium and a retention member that abuts against the application member to form a liquid retention space for retaining the liquid, wherein the liquid application means applies the liquid retained in the liquid retention space to the medium via the application member by rotating the application member; storage means for storing the liquid; first and second passages which allow the storage means and the retention member to communicate with each other; liquid moving means for causing the liquid to flow in a channel including the first passage, the liquid retention space, and the second passage; driving control means for controlling driving of the liquid moving means; acquisition means for acquiring information concerning a consumption of the liquid consumed during the application; and determination means for determining whether or not the consumption of the liquid indicated by the information which has been acquired by the acquisition means is larger than a predetermined quantity, wherein, when the determination means determines that the consumption of the liquid is larger than the predetermined quantity, the driving control means drives the liquid moving means to supply the liquid from the storage means to the liquid retention space, and stops driving of the liquid moving means after the supply is finished.

Further, in other aspect of the present invention, a liquid application device comprises liquid application means comprising an application member for applying a liquid to a medium and a retention member for retaining the liquid to be applied by the application member, wherein the liquid application means applies the liquid retained in the retention member to the medium via the application member by rotating the application member; storage means for storing the liquid; means for supplying the liquid from the storage means to the retention member; acquisition means for acquiring information concerning a consumption of the liquid consumed during the application; and control means for controlling whether or not a supply operation of the liquid from the storage means to the retention member is performed, on the basis of the information concerning the consumption of the liquid acquired by the acquisition means.

Further, in other aspect of the present invention, a liquid application device comprises liquid application means comprising an application member for applying a liquid to a medium and a retention member for retaining the liquid to be applied by the application member, wherein the liquid application means applies the liquid retained in the retention member to the medium via the application member by rotating the application member; a recording head for ejecting ink to the medium to which the liquid has been applied by the liquid application means; storage means for storing the liquid; and supply means for intermittently supplying the liquid from the storage means to the retention member, wherein the supply of the liquid by the supply means is performed before the liquid retained in the retention member has run out.

Further, in other aspect of the present invention, an inkjet recording apparatus comprises the liquid application device described above; and recording means for recording an image on a medium by ejecting ink from a recording head to the medium to which the liquid has been applied by the liquid application device.

Further, in other aspect of the present invention, a recording apparatus comprises the liquid application device described above; and recording means for recording an image on a medium by applying a recording agent to the medium to which the liquid has been applied by the liquid application device.

Further, in other aspect of the present invention, a method of controlling a liquid application device, comprises the steps of: providing the liquid application device comprising liquid application means comprising an application member for applying the liquid to the medium and a retention member that abuts against the application member to form a liquid retention space to retention the liquid in the liquid holding space, wherein the liquid application means applies the liquid retained in the liquid retention space to the medium via the application member by rotating the application member; supplying the liquid from storage means to the liquid retention space; acquiring information concerning a consumption of the liquid consumed during the application; and determining whether or not the supplying step is performed, on the basis of the information concerning the consumption of the liquid acquired in the acquiring step.

In the present invention, when a liquid (an application liquid, for example) is applied to an application medium, liquid moving means (a pump, for example) is not always operated. Instead, the liquid moving means is activated when the liquid has to be supplied to a liquid retention (holding) space. Accordingly, with the present invention, compared to the case where the liquid moving means is always operated during liquid application, the noise and/or the power consumption, for example, due to the operation of the liquid moving means can be reduced.

The above and other objects, effects, features and advantages of the present invention will become more apparent from the following description of embodiments thereof taken in conjunction with the accompanying drawings.

BRIEF DESCRIPTION OF THE DRAWINGS

FIG. 22 is a diagram showing an example of consumption quantities of the liquid to be added when the liquid application operation in the embodiment of the present invention is performed;

FIG. 25 is a diagram showing an example of Threshold Table used when the liquid application operation in the embodiment of the present invention is performed;

DETAILED DESCRIPTION OF PREFERRED EMBODIMENTS

First Embodiment

Detailed description will be given below of a preferred embodiment of the present invention with reference to the accompanying drawings.

Figure 1:
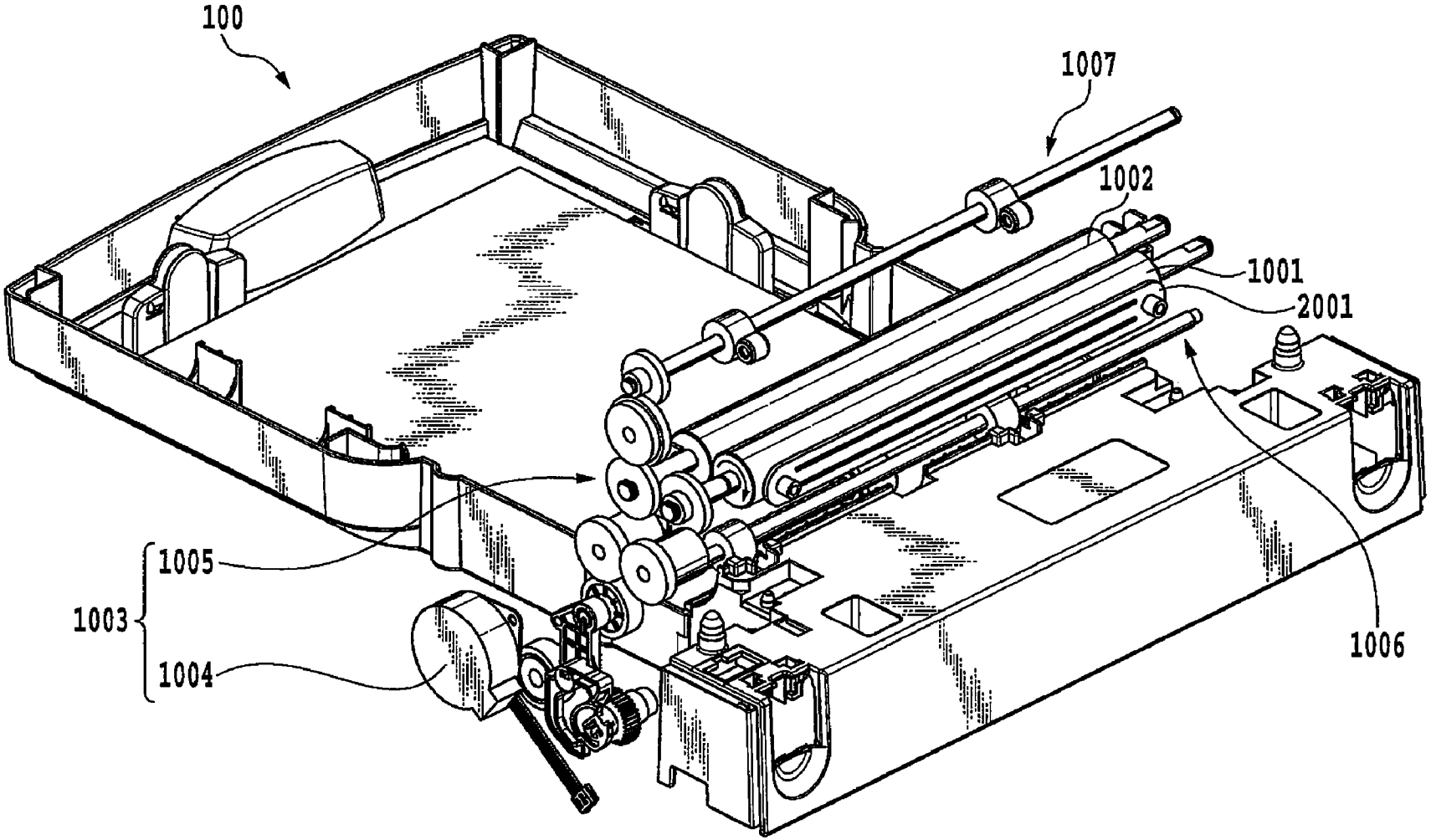
FIG. 1 is a perspective view showing an overall construction of an embodiment of a liquid application device of the present invention.

FIG. 1 is a perspective view showing an overall structure of the embodiment of a liquid application device 100 of the present invention. The liquid application device 100 shown here generally includes liquid application means for applying a predetermined application liquid to a medium (hereinafter also referred to as the application medium) which is an object to which the liquid is applied and liquid supply means for supplying the application liquid to the liquid application means.

The liquid application means includes a cylindrical application roller 1001, a cylindrical counter roller (a medium supporting member) 1002 placed so as to face the application roller 1001 and a roller drive mechanism 1003 driving the application roller 1001. The roller drive mechanism 1003 includes a roller drive motor 1004 and a power transmission mechanism 1005 including a gear train for transmitting the driving force of the roller drive motor 1004 to the application roller 1001.

The liquid supply means includes a liquid retention member 2001 retaining the application liquid between itself and a circumferential surface of the application roller 1001, and a liquid channel 3000 (not shown in FIG. 1), to be described later, supplying the liquid to the liquid retention member 2001. The application roller 1001 and the counter roller 1002 are freely rotatably supported individually by parallel shafts, each of which has both ends thereof freely rotatably fitted to a frame not shown. The liquid retention member 2001 extends substantially over the entire length of the application roller 1001, and is movably mounted to the frame via a mechanism which enables the liquid retention member 2001 to come into contact with or to separate from the circumferential surface of the application roller 1001.

The liquid application device of this embodiment further includes an application medium feeding mechanism 1006 for transferring the application medium to a nip area between the application roller 1001 and the counter roller 1002, the application medium feeding mechanism 1006 being constituted of a pickup roller and other elements. In a transfer path of the application media, a sheet discharging mechanism 1007 transferring, to a sheet discharging unit (not shown), the application medium to which the application liquid has been applied is provided downstream of the application roller 1001 and the counter roller 1002, the sheet discharging mechanism 1007 having a sheet discharging roller and other elements. As in the case of the application roller and the like, these paper feeding mechanism and the sheet discharging mechanism are operated by the driving force of the drive motor 1004 transmitted via the power transmission mechanism 1005.

It should be noted that the application liquid used in this embodiment is a liquid used for the purpose of advancing the start of the coagulation of pigment when recording is carried out using an ink which contains pigment as a coloring material.

An example of components of the application liquid is described below.

| | |
|---|---|
| calcium nitrate tetrahydrate | 10% |
| glycerin | 42% |
| surface-active agent | 1% |
| water | the rest |

The viscosity of the application liquid is from 5 to 6 cP (centipoises) at 25° C.

Needless to say, in application of the present invention, the application liquid is not limited to the above liquid. As another application liquid, for example, a liquid which contains a component insolubilizing the dye or causing the coagulation of the dye, can be used. As yet another application liquid, a liquid which contains a component suppressing curling of the application media (the phenomenon that the media take a curved shape), can be used.

In a case where water is used in the applied liquid, the sliding property at the contact area of the liquid retention member with the application roller of the present invention will be improved by mixing a component reducing the surface tension with the liquid. In the above example of the components of the applied liquid, glycerin and the surface-active agent are the components reducing the surface tension of water.

More detailed description will now be given of construction of each portion.

Figure 2:
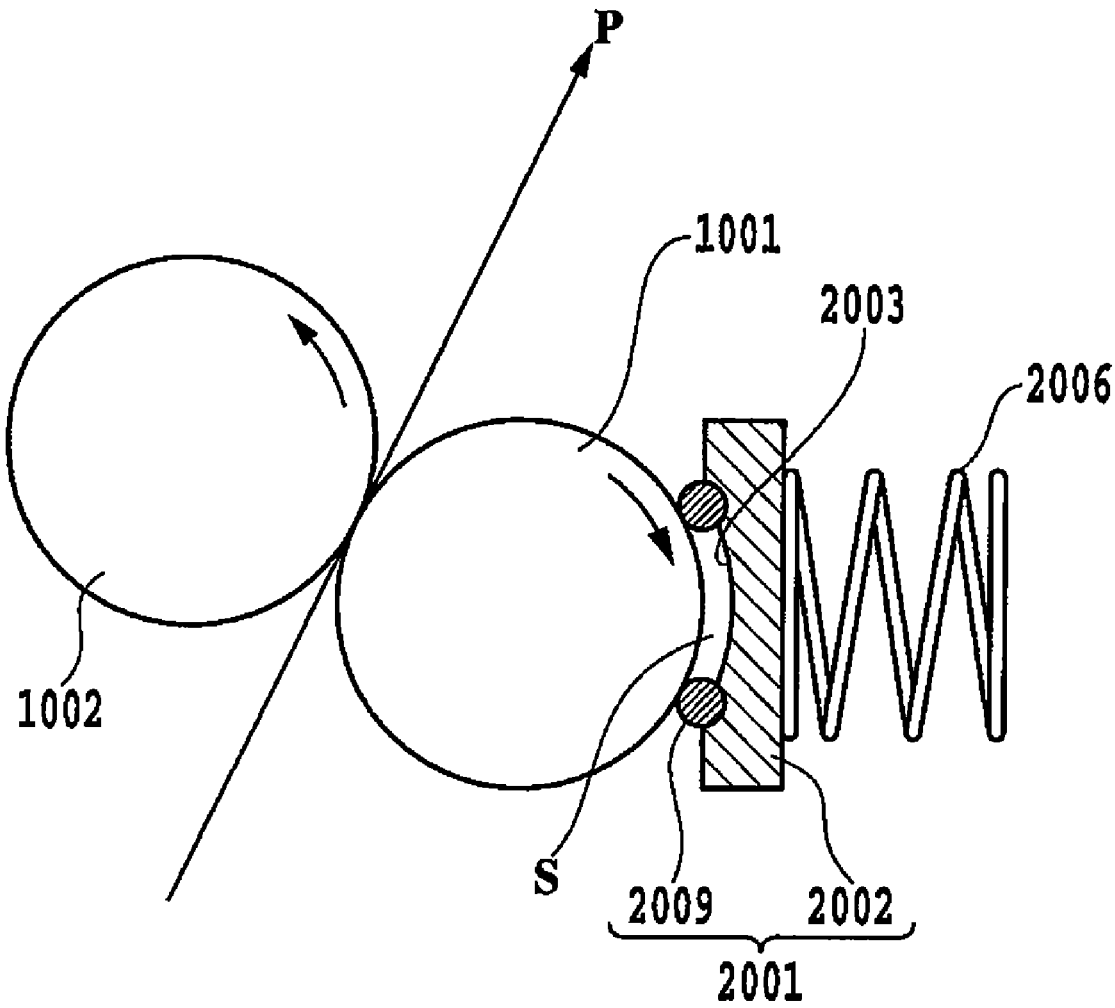
FIG. 2 is a longitudinal sectional side view showing an example of an arrangement of elements including an application roller, a counter roller and a liquid retention member.

FIG. 2 is an explanatory longitudinal sectional side view showing an example of an arrangement of elements including the application roller 1001, the counter roller 1002 and the liquid retention member 2001.

The counter roller 1002 is biased toward the circumferential surface of the application roller 1001 by bias means not shown, and rotates the application roller 1001 clockwise in the figure. This rotation makes it possible to hold, between both rollers, the application medium P to which the application liquid is applied, and to transfer the application medium P in the direction indicated by the arrow in the figure.

The liquid retention member 2001 is designed to create an elongated liquid retention space S extending across a liquid application region of the application roller 1001 while the liquid retention member 2001 abuts on the circumferential surface of the application roller 1001, biased thereto by the bias force of a spring member (pressing means) 2006. The application liquid is supplied from the below-described liquid channel 3000 into the liquid retention space S through the liquid retention member 2001. In this case, since the liquid retention member 2001 is constructed as described below, it is possible to prevent the application liquid from accidentally leaking out of the liquid retention space S while the application roller 1001 is stopped.

A construction of the liquid retention member 2001 is shown in FIGS. 3 to 8.

Figure 3:
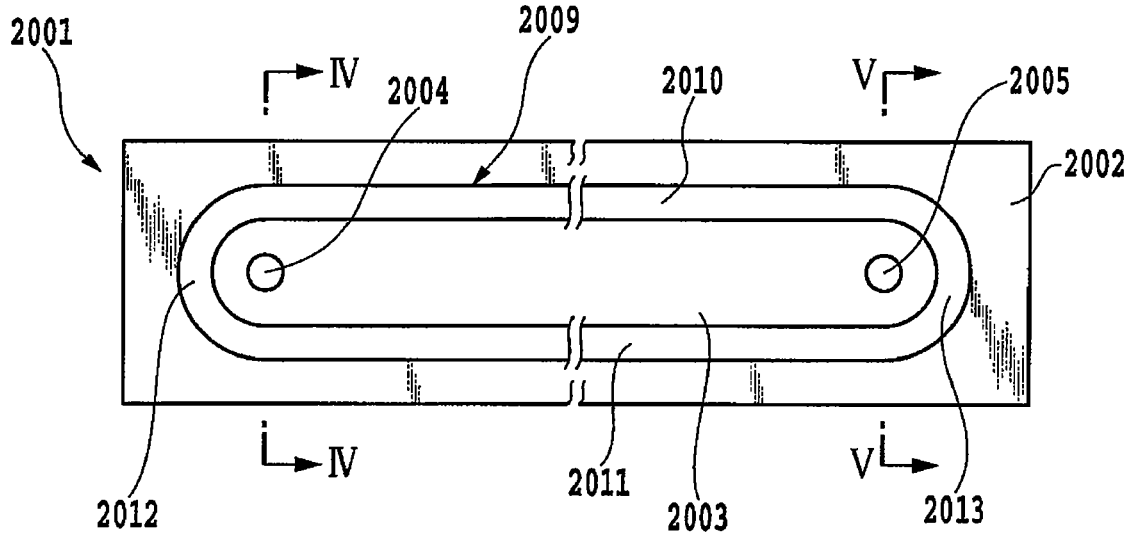
FIG. 3 is a front view of the liquid retention member shown in FIGS. 1 and 2.

As shown in FIG. 3, the liquid retention member 2001 includes a space creating base 2002 and an annular contact member 2009 provided on one surface of the space creating base 2002 in a protruding manner. In the space creating base 2002, a concave portion 2003, a bottom portion of which has a circular-arc cross section, is formed in the middle thereof along the longitudinal direction. Each straight portion of the contact member 2009 is fixedly attached to the space creating base 2002 along the edge portion of the concave portion 2003, and each circumferential portion thereof is fixedly attached to the space creating base 2002 so as to run from one edge portion to the other edge portion via the bottom portion. In this way, when abutting on the application roller 1001, the contact member 2009 of the liquid retention member 2001 can abut thereon in conformity with the shape of the circumferential surface of the application roller, which realizes the abutting with a uniform pressure.

As described above, with regard to the liquid retention member in this embodiment, the seamless contact member 2009 formed in one body is caused to abut on the outer circumferential surface of the application roller 1001 consecutively with no space therebetween by the bias force of the spring member 2006. As a result, the liquid retention space S becomes a substantially closed space defined by the contact member 2009, one surface of the space creating base and the outer circumferential surface of the application roller 1001, and the liquid is retained in this space. Thus, while the rotation of the application roller 1001 is stopped, the contact member 2009 and the outer circumferential surface of the application roller 1001 can keep a fluid-tight state, and can surely prevent the liquid from leaking out. On the other hand, when the application roller 1001 rotates, as described later, the application liquid can go past the contact member 2009 in such a manner as to pass through the interface between the outer circumferential surface of the application roller 1001 and the contact member 2009. "While the application roller 1001 is stopped, the outer circumferential surface thereof and the contact member 2009 are in a fluid-tight state" means that, as described above, the liquid is not allowed to pass through the boundary between the inside and the outside of the space. In this case, the abutting condition of the contact member 2009 includes a condition where the contact member 2009 abuts on the outer circumferential surface of the application roller 1001 with a film of the liquid, which is formed by the capillary action, interposed therebetween, as well as a condition where the contact member 2009 directly abuts on the outer circumferential surface of the application roller 1001.

Figure 4:
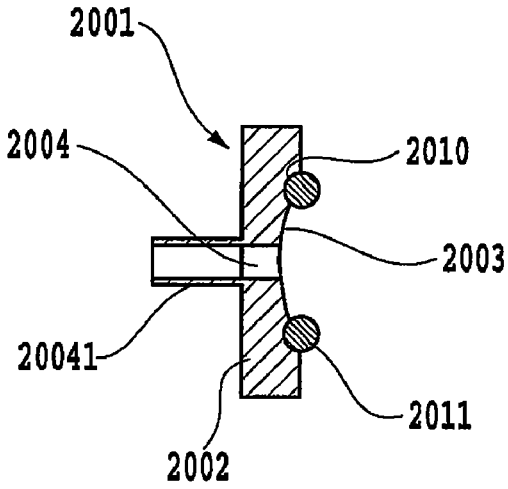
FIG. 4 is an end view showing an end obtained by cutting the liquid retention member shown in FIG. 3 along the line IV-IV.
Figure 5:
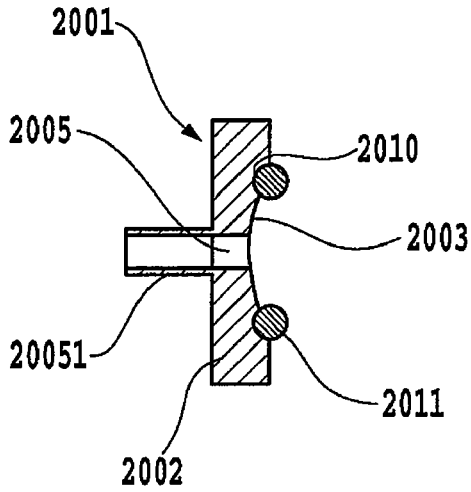
FIG. 5 is an end view showing an end obtained by cutting the liquid retention member shown in FIG. 3 along the line V-V.
Figure 6:
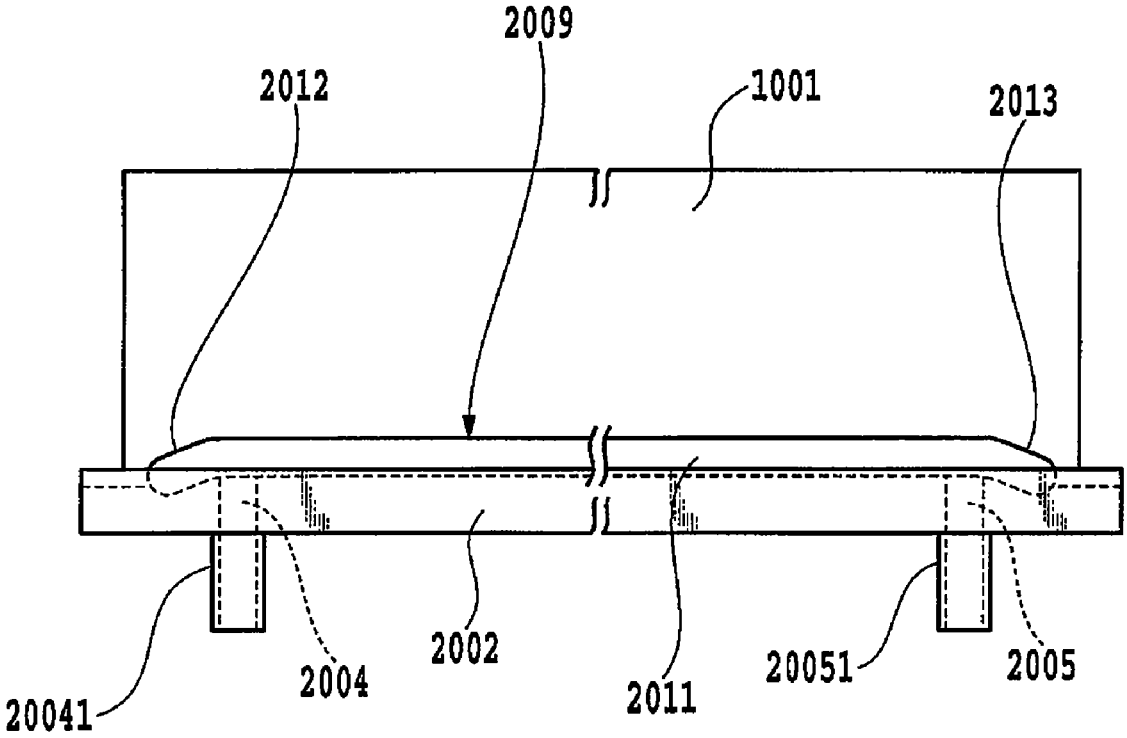
FIG. 6 is a plan view of the liquid retention member shown in FIG. 3.
Figure 7:
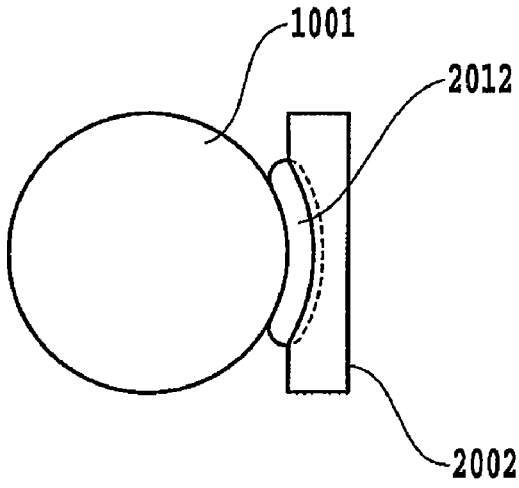
FIG. 7 is a left side view showing a state where a contact portion of the liquid retention member shown in FIG. 3 is allowed to abut on the liquid application roller.
Figure 8:
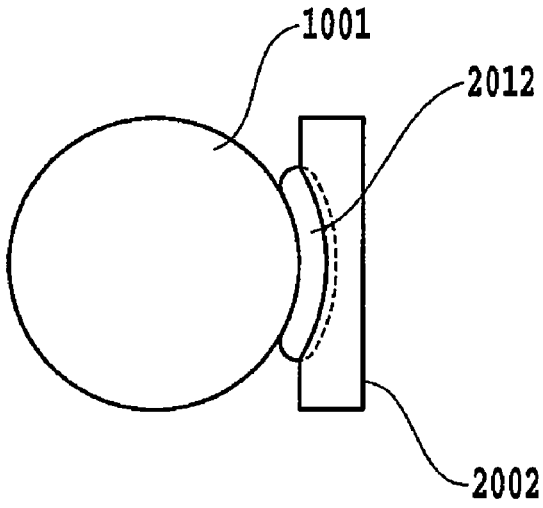
FIG. 8 is a right side view showing a state where the contact portion of the liquid retention member shown in FIG. 3 is allowed to abut on the liquid application roller.

The left and right end portions of the contact member 2009 in the longitudinal direction have a gently curved shape when viewed from any one of the front thereof (FIG. 3), the top thereof (FIG. 6), and a side thereof (FIGS. 7 and 8), as shown in FIGS. 3 to 8. As a result, even when the contact member 2009 is allowed to abut on the application roller 1001 with a relatively high pressure, the whole contact member 2009 is elastically deformed substantially uniformly, and local large deformation does not occur. Thus, the contact member 2009 abuts on the outer circumferential surface of the application roller 1001 consecutively with no space therebetween, and can create the substantially closed space, as shown in FIGS. 6 to 8.

On the other hand, as shown in FIGS. 3 to 5, the space creating base 2002 is provided with a liquid supply port 2004 and a liquid collection port 2005 in the region surrounded by the contact member 2009, each port being formed by making a hole penetrating the space creating base 2002. These ports communicate with cylindrical joint portions 20041 and 20051, respectively, which are provided on a back side of the space creating base in a protruding manner. The joint portions 20041 and 20051 are in turn connected to the below-described liquid channel 3000. In this embodiment, the liquid supply port 2004 is formed near one end portion (the left end portion in FIG. 3) of the region surrounded by the contact member 2009, and the liquid collection port 2005 is provided near the other end portion (the right end portion in FIG. 3) of the same region. The liquid supply port and the liquid collection port are not limited by the above configuration, and may be formed at any location in the space creating base. In addition, the number of the liquid supply ports and the number of the liquid collection ports may be arbitrary. The liquid supply port 2004 is used to supply, to the above-described liquid retention space S, the application liquid supplied from the liquid channel 3000. The liquid collection port 2005 is used to allow the liquid in the liquid retention space S to flow out to the liquid channel 3000. By supplying the liquid and allowing the liquid to flow out, the application liquid is caused to flow from the left end portion to the right end portion in the liquid retention space S.

(Application Liquid Channel)

Figure 11:
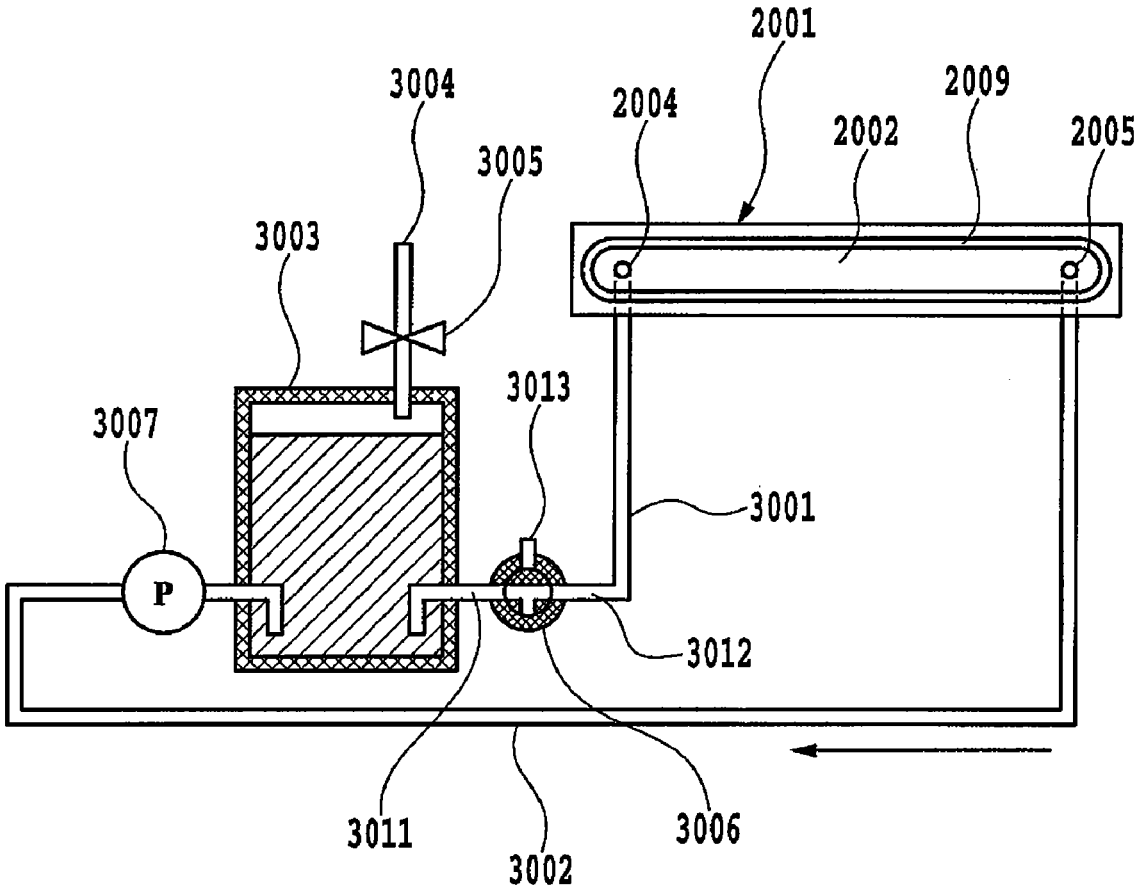
FIG. 11 is a diagram showing a schematic configuration of a liquid channel of the liquid application device in the embodiment of the present invention.

FIG. 11 is an explanatory diagram showing a schematic configuration of the liquid channel 3000 connected to the liquid retention member 2001 of the application liquid supply means.

The liquid channel 3000 has a first channel 3001 which connects the liquid supply port 2004 of the space creating base 2002 being an element of the liquid retention member 2001, and a storage tank 3003 storing the application liquid. In addition, the liquid channel 3000 has a second channel 3002 which connects the liquid collection port 2005 of the space creating base 2002 and the storage tank 3003. This storage tank 3003 is provided with an atmosphere communication port 3004, and the atmosphere communication port is provided with an atmosphere communication valve 3005 switching between an atmosphere communicating state and an atmosphere isolation state. The atmosphere communication port 3004 preferably has a labyrinth structure in order to suppress vaporization. In addition, a switching valve 3006 is provided in the first channel 3001, making it possible to switch between the state where the first channel 3001 and the atmosphere communicate with each other and the state where these are isolated from each other. In the second channel 3002, a pump 3007 is connected, which is used to force the application liquid and air to flow in a desired direction in the liquid channel 3000. In this embodiment, the pump 3007 causes the liquid to flow in the direction from the first channel 3001 to the second channel 3002 via the liquid retention space S.

In this embodiment, the first and second channels 3001 and 3002 are formed of circular tubes. Openings formed at respective ends of the tubes are located at or near the bottom of the storage tank 3003, so that the application liquid in the storage tank 3003 can be completely consumed.

Figure 12:
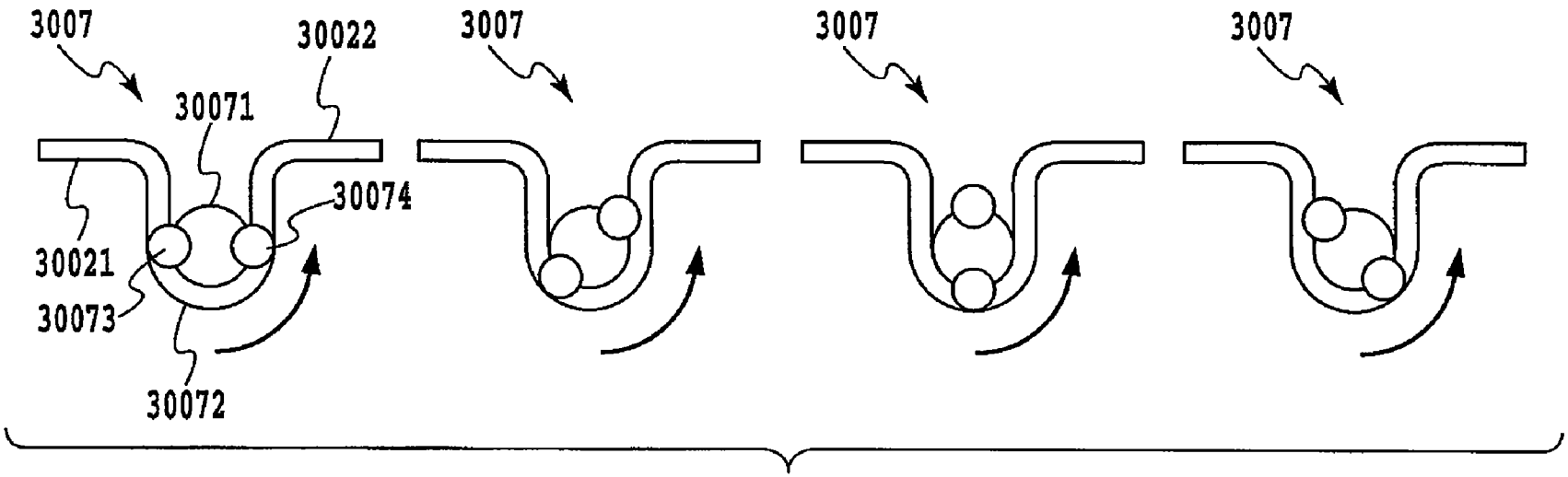
FIG. 12 is a diagram for explaining an operation of a pump in the embodiment of the present invention.

The pump 3007 in this embodiment is constituted of a tube pump as shown in FIG. 12. The tube pump 3007 includes a rotor 30071 rotated by a pump drive motor (not shown) and a pump forming tube 30072 having flexibility, which is disposed in an arc shape along the periphery of the rotor 30071. In addition, the tube pump 3007 has two rollers 30073 and 30074 freely rotatably supported by the rotor 30071. In this tube pump, when the rotor 30071 rotates, at least one of the rollers 30073 and 30074 rolls while squeezing the pump forming tube 30072. This rolling movement causes the application liquid or air in the pump forming tube 30072 to be fed to the downstream side (to the storage-tank side tube 30022 in FIG. 12), and, at the same time, causes the application liquid or air to be sucked from the liquid-retention-member side tube 30021. While the tube pump 3007 is stopped, the pump forming tube is always in a squeezed state, and the communication between the tubes 30021 and 30022 is blocked.

Figure 13:
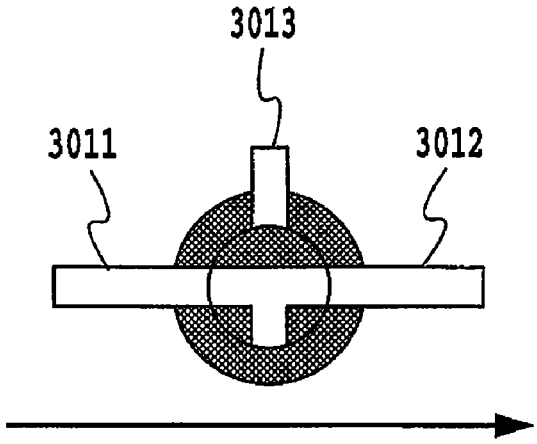
FIG. 13 is a diagram showing a state where tubes 3011 and 3012 are allowed to communicate with each other by a three-way valve 3006.
Figure 14:
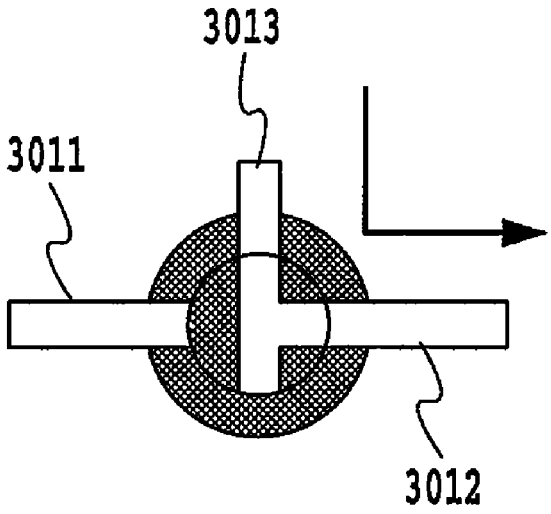
FIG. 14 is a diagram showing a state where the tube 3012 and an atmosphere communication port 3013 are allowed to communicate with each other by the three-way valve 3006.

For the switching valve 3006 in this embodiment, various kinds of valves can be used as long as the valve can switch between the state where the first channel 3001 and the atmosphere communicate with each other and the state where these are isolated from each other. In this embodiment, however, a three-way valve as shown in FIG. 11 is used. The three-way valve 3006 has three ports communicating with each other. The three-way valve 3006 can allow two of these ports to selectively communicate with two of a storage-tank side tube 3011, a liquid-retention-member side tube 3012 and an atmosphere communication port 3013 in the first channel 3001. The switching of this three-way valve 3006 allows for the selective switching between a connection state where the tubes 3011 and 3012 are allowed to communicate with each other and a connection state where the tube 3012 and the atmosphere communication port 3013 are allowed to communicate with each other. In this way, it is made possible to selectively supply, to the liquid retention space S created by the liquid retention member 2001 and the application roller 1001, the application liquid in the storage tank 3003 or the air taken in from the atmosphere communication port 3013. Specifically, when the tubes 3011 and 3012 communicate with each other as shown in FIG. 13, the application liquid in the storage tank 3003 will be supplied to the liquid retention space S. On the other hand, when the tube 3012 and the atmosphere communication port 3013 communicate with each other as shown in FIG. 14, the air taken in from the atmosphere communication port 3013 is supplied to the liquid retention space S. The switching of the three-way valve 3006 is performed in accordance with a control signal from a below-described control unit 4000, so that the filling or the supply of the application liquid is performed.

As described above, although the pump 3007 is provided in the second channel 3002 in this embodiment, the present invention is not limited thereto. Specifically, the pump 3007 may be provided in the first channel.

(Control System)

Figure 15:
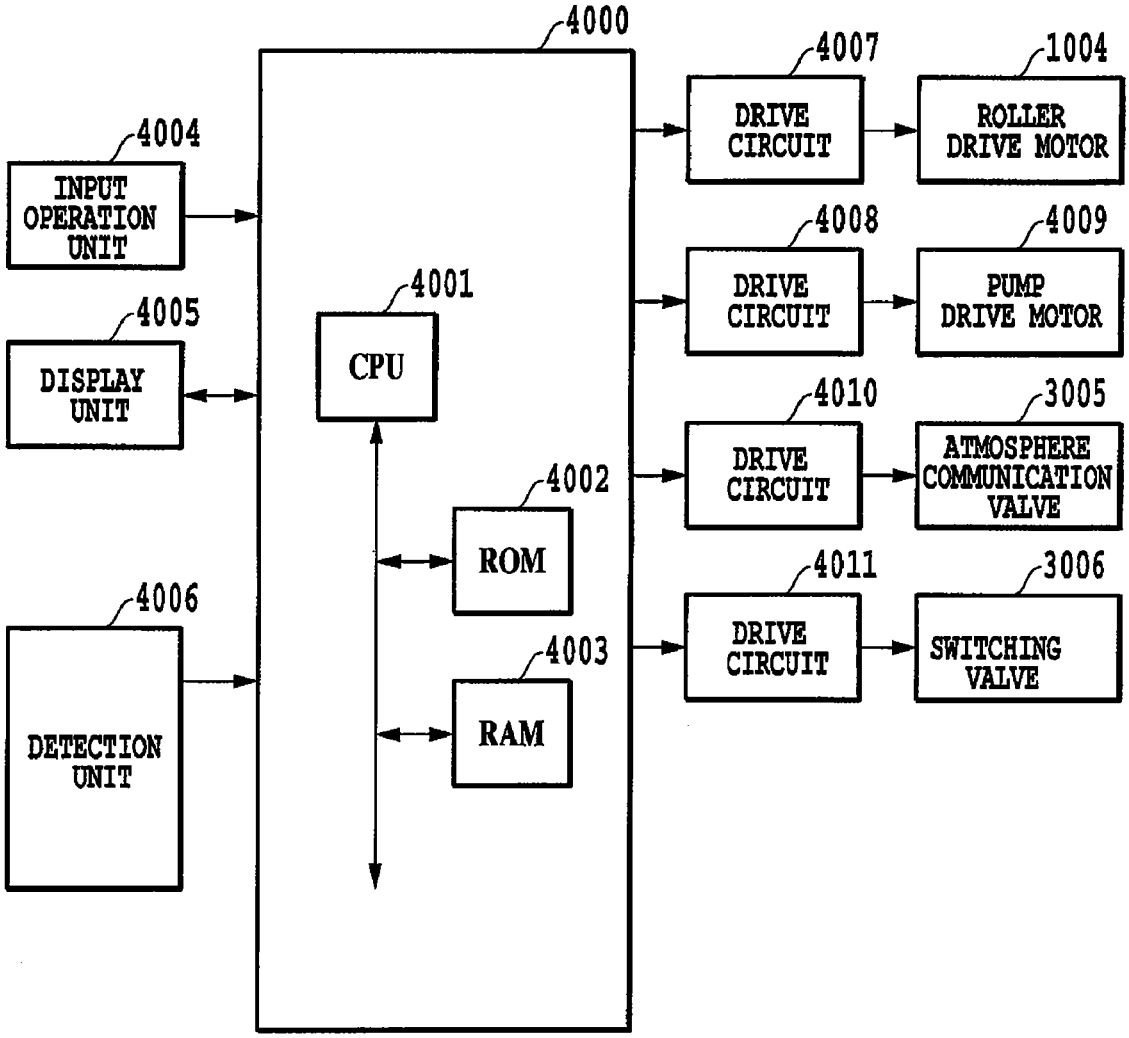
FIG. 15 is a block diagram showing a schematic configuration of a control system in the embodiment of the present invention.

FIG. 15 is a block diagram showing a schematic configuration of a control system in the liquid application device of this embodiment.

In FIG. 15, the control unit 4000 is a control unit as control means for controlling the whole liquid application device. This control unit 4000 includes a CPU 4001 performing various processing, such as computation, control, and determination and a ROM 4002 storing a control program and the like for processes described later using FIGS. 16, 20, 21, 23 and 24. The control unit 4000 further includes a RAM 4003 temporarily storing input data and data generated during processing by the CPU 4001. The control unit 4000 has a function of acquiring information concerning the consumption of the application liquid described later, and a function of controlling, on the basis of the information concerning the consumption of the application liquid, the supply operation of the liquid to the liquid retention space S which is performed by liquid moving means (pump).

An input operation unit 4004 including a keyboard or various switches with which a predetermined command, data or the like is inputted, and a display unit 4005 displaying various information, such as input, settings, or the like of the liquid application device, are connected to the control unit 4000. In addition, a detection unit 4006 including a sensor for detecting the position of an application medium, the operation condition of each portion, or the like, is connected to the control unit 4000. Moreover, the roller drive motor 1004, a pump drive motor 4009, the atmosphere communication valve 3005 and the switching valve 3006 are connected to the control unit 4000 via drive circuits 4007, 4008, 4010 and 4011, respectively. It should be noted that the sensor being an element of the detection unit 4006 includes an application medium detecting sensor in the first embodiment, a size detecting sensor in a second embodiment, and a temperature sensor in a fourth embodiment, for example.

In this embodiment, with the use of the above configuration, during an application operation (a liquid application operation) in which the application liquid is applied to application media, the stop and the activation (driving) of the pump 3007 is controlled in accordance with predetermined timing.

(Liquid Application Operation Sequence)

Figure 16:
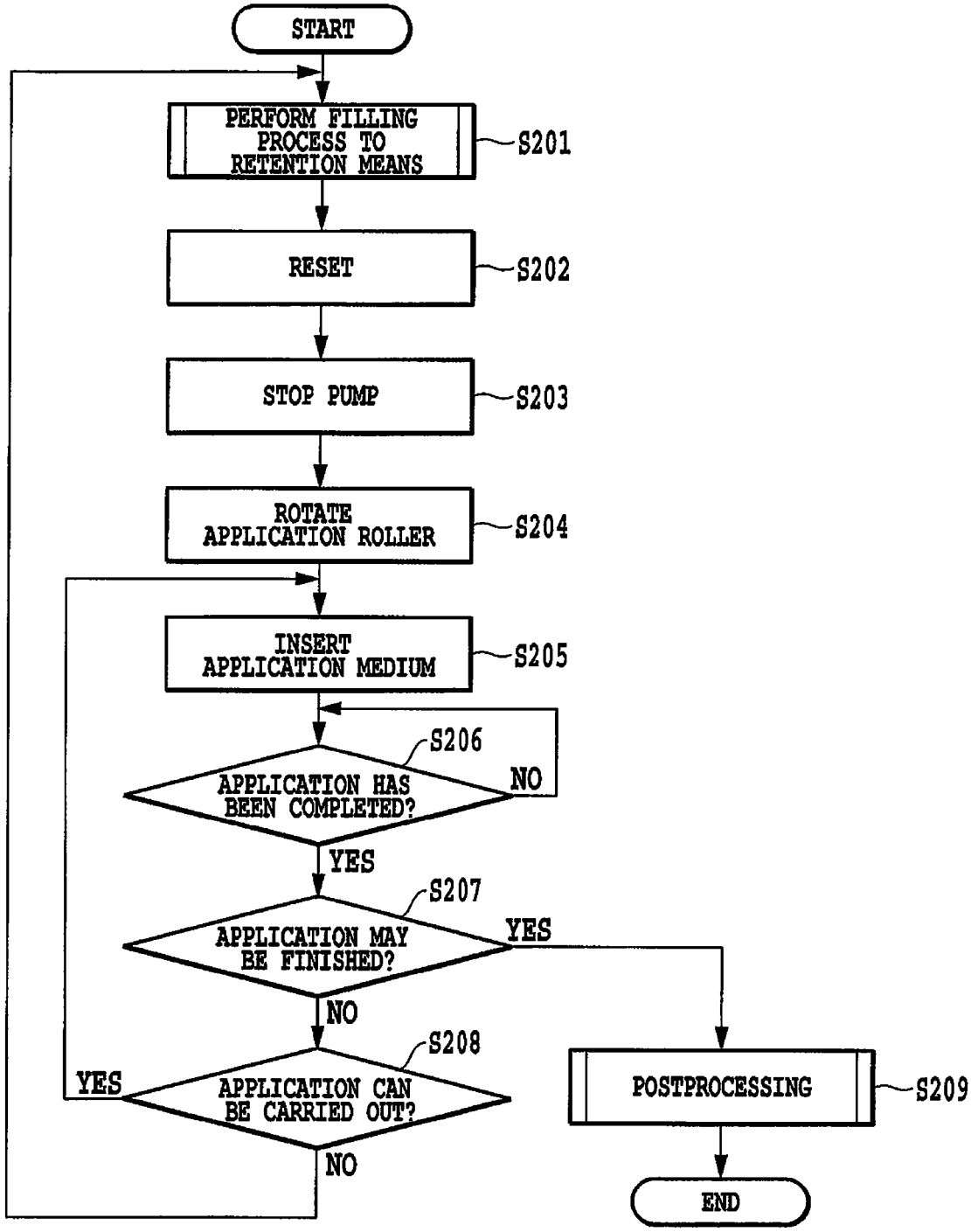
FIG. 16 is a flow chart showing a liquid-application operation sequence in the embodiment of the present invention.

FIG. 16 is a flow chart showing a procedure relating to the liquid application by the liquid application device of this embodiment. Description will be given below of each step relating to the liquid application with reference to this flow chart. Once the liquid application device is turned on, the control unit 4000 carries out the following application operation sequence in accordance with the flow chart shown in FIG. 16.

In step S201, a step of filling the application liquid into the liquid retention space S is performed. In this filling step, first of all, the atmosphere communication valve 3005 of the storage tank 3003 is opened to the atmosphere, and, at the same time, the pump 3007 is driven during a certain period of time. Thus, if the liquid retention space S, and the channels 3001 and 3002 are not filled with the application liquid, the inside air is sent to the storage tank 3003 via the pump and discharged to the atmosphere, and, at the same time, the application liquid is filled into the respective portions. If the respective portions are already filled with the application liquid (that is, after it is determined that a below-described predetermined amount of application liquid has been consumed), the application liquid in the respective portions flows, and a suitable amount of application liquid (the amount substantially corresponding to the amount of the application liquid consumed during the liquid application operation, for example) having a proper concentration and viscosity is supplied. This operation results in a state where the application liquid has been supplied to the application roller 1001, making it possible to apply the liquid to an application medium. Subsequently, if information corresponding to the liquid consumption which is the amount of the application liquid consumed by the use of the application roller 1001 (a count value of application media described later, for example) is stored in the RAM 4003, the information is reset to zero (step S202). Driving of the pump 3007 is then stopped (step S203).

After the liquid retention space S has been filled with the application liquid, an application step shown in steps S204 to S206 is performed. Specifically, the application roller 1001 starts to rotate clockwise as shown by the arrow in FIG. 9 (step S204). If the application roller 1001 is already rotating in step S204, the rotation is continued. With this rotation of the application roller 1001, the application liquid L filled into the liquid retention space S overcomes the pressing force of the contact member 2009 of the liquid retention member 2001 against the application roller 1001, and passes through the interface between the application roller 1001 and a lower edge portion 2011 of the contact member 2009. The application liquid L having passed sticks to the outer circumferential surface of the application roller 1001 in a laminar manner. The application liquid L sticking to the application roller 1001 is sent to the contact portion between the application roller 1001 and the counter roller 1002.

Subsequently, the application medium feeding mechanism 1006 transfers an application medium to the interface between the application roller 1001 and the counter roller 1002, allowing the application medium to be inserted between these rollers. The inserted application medium is then transferred toward the sheet discharging unit as the application roller 1001 and the counter roller 1002 rotate (step S205). At this time, the transferred application medium is detected by the sensor of the detection unit 4006 provided upstream of the application roller 1001 and the counter roller 1002. In response to the detection, the count of one is stored in the RAM 4003 on the basis of a detection signal sent by the sensor. In this embodiment, "the count of N" corresponds to the application to N application media. The count value is cumulatively increased by one every time the sensor detects an application medium, and the accumulated count value is stored in the RAM 4003.

In this embodiment, the sensor may be provided downstream of the application roller 1001 and the counter roller 1002 to detect the application medium.

Figure 9:
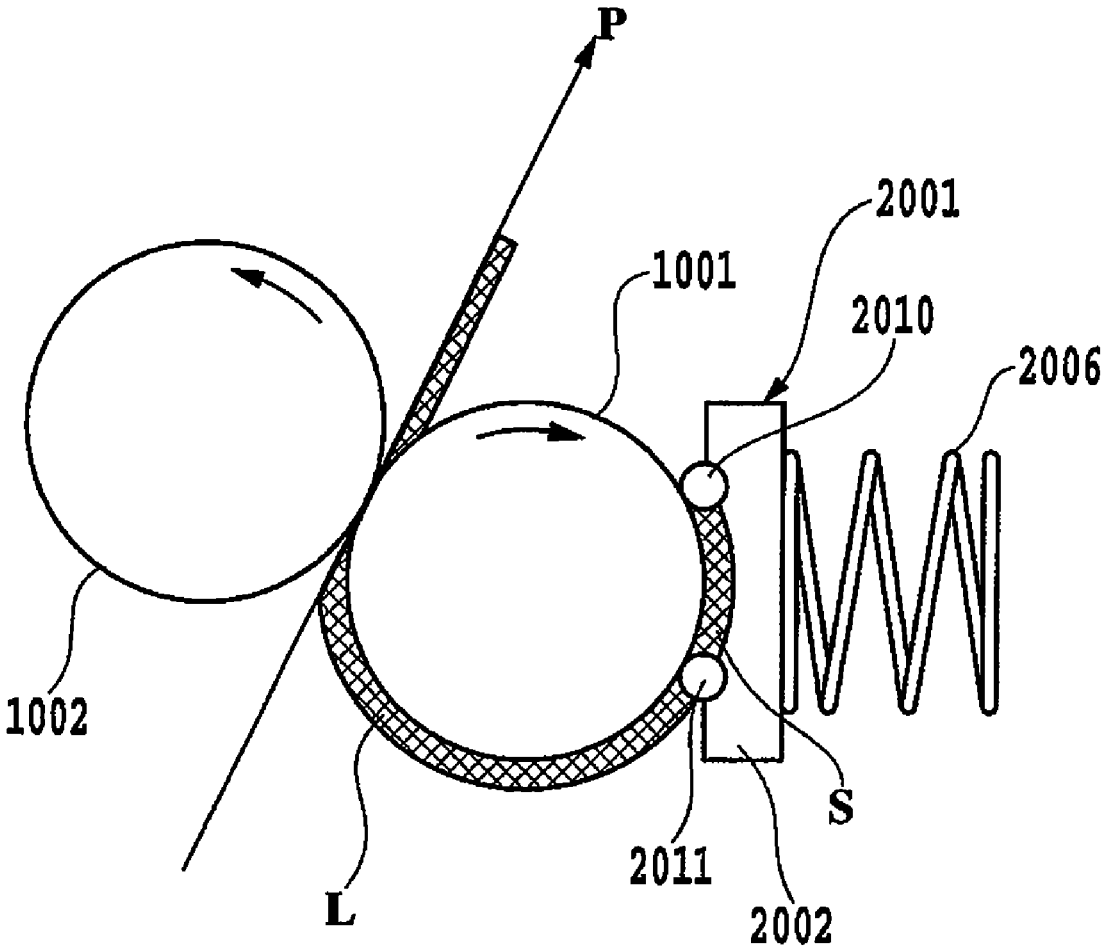
FIG. 9 is a longitudinal sectional view showing a state where a liquid retention space created by the liquid retention member and the application roller is filled with an application liquid, and the liquid is applied to an application medium as the application roller rotates in the embodiment of the present invention.

During the transfer, the application liquid applied to the circumferential surface of the application roller is transferred from the application roller 1001 to the application medium P as show in FIG. 9. Needless to say, the means for feeding the application medium to the interface between the application roller 1001 and the counter roller 1002 is not limited to the above feeding mechanism. Any means can be used. For example, manual feeding means ancillary utilizing a predetermined guide member may be additionally used, or the manual feeding means may be used singly.

In FIG. 9, the cross hatched part indicates the application liquid L. It should be note that, in this figure, the thicknesses of the layers of the application liquid on the application roller 1001 and the application medium P is depicted relatively larger than the actual thickness, for the purpose of the clear illustration of the state of the application liquid L shown at the time of the application.

In this way, the part of an application medium P to which the liquid has been applied is transferred in the direction indicated by the arrow by the transferring force of the application roller 1001, and, at the same time, the part of the application medium P to which the liquid is not applied is transferred to the contact area between the application medium P and the application roller 1001. By performing this operation continuously or intermittently, the application liquid is applied to the entire surface of the application medium.

Incidentally, FIG. 9 shows an ideal state of application where all the application liquid L, which has passed the contact member 2009 and has stuck to the application roller 1001, has been transferred to the application medium P. In fact, however, all the application liquid L having stuck to the application roller 1001 is not always transferred to the application medium P. Specifically, in many cases, when the transferred application medium P moves away from the application roller 1001, the application liquid L also sticks to the application roller 1001, and thus remains on the application roller 1001. The remaining amount of the application liquid L on the application roller 1001 varies depending on the material of the application medium P and the microscopic irregularities of the surface. In a case where the application medium is a plain paper, the application liquid L remains on the circumferential surface of the application roller 1001 after the application operation.

Figure 17:
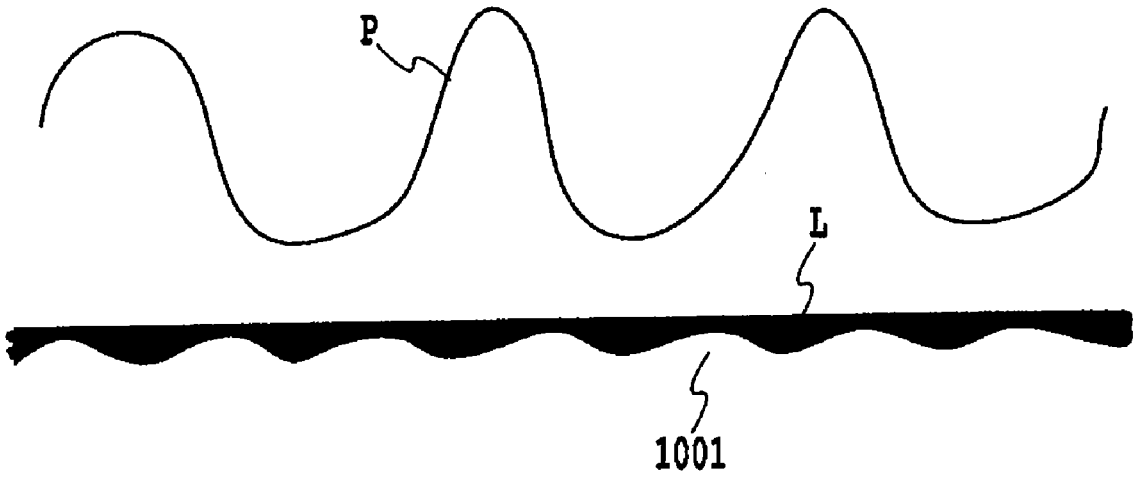
FIG. 17 is explanatory diagrams for explaining an application process proceeding between an application surface and a surface of the medium in a case where the medium P is a plain paper.
Figure 18:
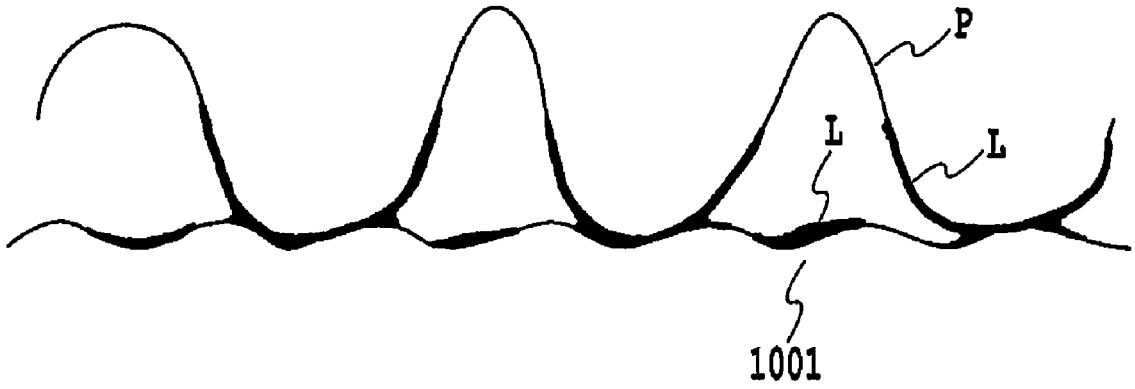
FIG. 18 is explanatory diagrams for explaining an application process proceeding between an application surface and a surface of the medium in a case where the medium P is a plain paper.
Figure 19:
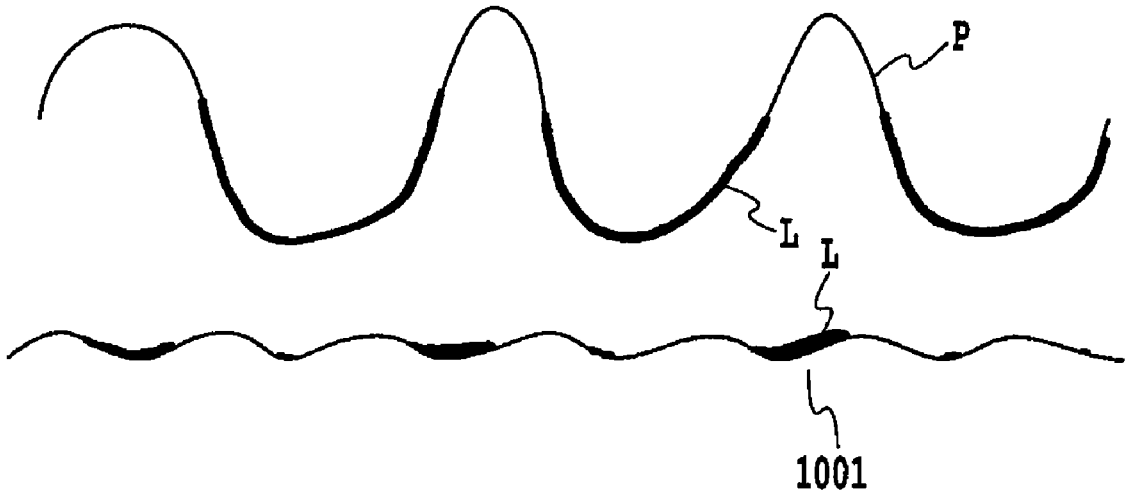
FIG. 19 is explanatory diagrams for explaining an application process proceeding between an application surface and a surface of the medium in a case where the medium P is a plain paper.

FIGS. 17 to 19 are explanatory diagrams for explaining an application process proceeding between the application surface and the surface of the medium in a case where the medium P is a plain paper. In these figures, the liquid is expressed by the regions filled in with black.

FIG. 17 shows a state of the application roller 1001 and the counter roller 1002 in an area upstream of the nip area thereof. In this figure, the liquid has stuck to the application surface of the application roller 1001 in such a manner that the liquid thinly covers the microscopic irregularities of the application surface.

FIG. 18 shows a state of both of the surface of the plain paper, which is the medium P, and the application surface of the application roller 1001 in the nip area of the application roller 1001 and the counter roller 1002. In this figure, the convex portions of the surface of the plain paper, which is the medium P, abuts on the application surface of the application roller 1001, and, from the abutting portions, the liquid instantly permeates into or sticks on the surface fibers of the plain paper, which is the medium P. The liquid which has stuck to the part of the application surface of the application roller 1001, which part does not abut on the convex portions of the surface of the plain paper, remains on the application surface of the application roller 1001.

FIG. 19 shows a state of the application roller 1001 and the counter roller 1002 in an area downstream of the nip area thereof. This figure shows a state where the medium and the application surface of the application roller 1001 have been completely separated from each other. The liquid sticking to those parts of the applying surface of the application roller 1001 which do not contact with the convex portions on the surface of the plain paper remains on the applying surface. The liquid on the contacting parts also remains with very small amount on the application surface.

The application liquid remaining on the application roller 1001 overcomes the pressing force of the contact member 2009 of the liquid retention member 2001 against the application roller 1001, passes through the interface between the application roller 1001 and an upper edge portion 2010 of the contact member 2009, and is brought back into the liquid retention space S. The returned application liquid is mixed with the application liquid filled in the liquid retention space S.

Figure 10:
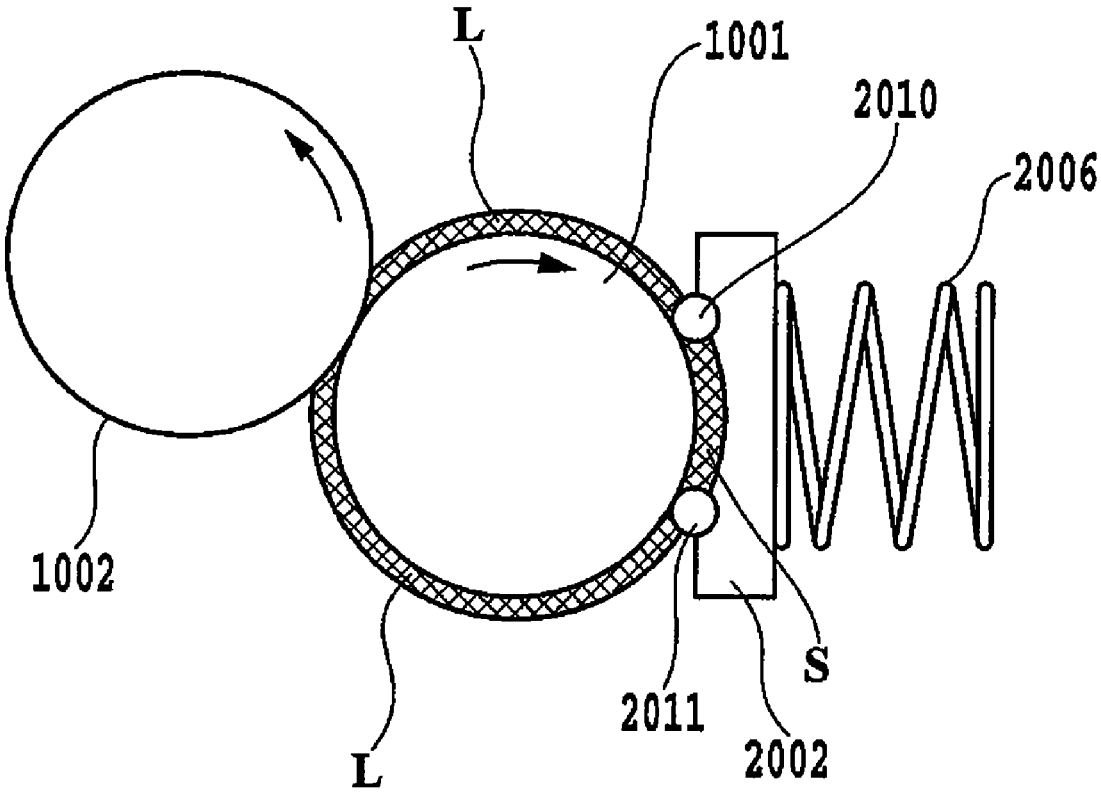
FIG. 10 is a longitudinal sectional view showing a state where the liquid retention space created by the liquid retention member and the application roller is filled with the application liquid, and the application roller is rotated with no application medium present in the embodiment of the present invention.

As shown in FIG. 10, also in a case where the application roller 1001 is rotated when there is no application medium, the returning operation of the application liquid is similarly performed. Specifically, the application liquid stuck to the circumferential surface of the application roller 1001 by rotating the application roller 1001 passes through the interface of the contact area between the application roller 1001 and the counter roller 1002. After this, the application liquid is distributed between the application roller 1001 and the counter roller 1002, and remains on the application roller 1001. The application liquid L sticking to the application roller 1001 passes through the interface between the upper edge portion 2010 of the contact member 2009 and the application roller 1001, enters the liquid retention space S, and is mixed with the application liquid filled in the liquid retention space S.

After the application operation to the application medium is performed as described above, the determination as to whether or not the application to the application medium has been completed, is made (step S206). If the application is not completed, this step is repeated to repeat the application operation until the application to the application medium is performed all over the part to which the application is required.

After the application operation to the application medium has been performed, the determination as to whether or not the application step may be finished, that is, as to whether or not there is a following application medium, is made in step S207. The determination as to whether or not the application may be finished in this step is carried out on the basis of a detection signal from the sensor (or another sensor than the above sensor, which is also provided upstream of the application roller 1001 and the counter roller 1002). If the detection signal is sent from the sensor in a predetermined period of time, that is, if the next application medium is being fed, it is determined that the application step has to be continued, and the process proceeds to step S208. On the other hand, if the detection signal is not sent from the sensor in the predetermined period of time, that is, if the next application medium is not being fed, it is determined that the application step may be finished, and the process proceeds to step S209 to perform postprocessing.

The determination as to whether or not the application step may be finished in this step is not limited to that described above. Any means can be used to make the determination, as long as the means can be used to determine whether or not the application operation to the next application medium has to be performed; for example, an embodiment may be adopted in which the determination is made on the basis of an application start command including information specifying the number of the application media to which the liquid is to be applied.

In step S208, the determination as to whether or not a suitable amount of the application liquid is retained in the liquid retention space S, and the application liquid can therefore be applied via the application roller, is made. Specifically, in this step, the determination as to whether or not the application liquid consumed during the above application operation exceeds a predetermined consumption, is made. This determination is made by comparing the count value stored in the RAM 4003 in step S205 and the prescribed application-performable number of sheets stored in the ROM 4002 in advance. If the count value is larger than the prescribed application-performable number of sheets, it is determined that the application cannot be carried out, and the process returns to step S201. In step S201, by driving the pump 3007 to circulate the application liquid as described above, the filling operation is again performed to the liquid retention space S. If the count value is equal to or smaller than the prescribed application-performable number of sheets, it is determined that the application can be carried out, the process proceeds to step S205, and the application operation to the next medium is performed. In this way, in step S208, the determination as to whether or not the application liquid has to be filled into the liquid retention space S is made.

As described above, although the count is performed before the actual application operation, the determination as to whether or not the application liquid can be applied to the application roller is made after the application of the application liquid to the application media, which has contributed the count, has been completed. Accordingly, the accumulated count value substantially corresponds to the amount of the application liquid consumed during the application operation.

In this embodiment, the "prescribed application-performable number of sheets" is a threshold to indicate the necessity of filling the application liquid into the liquid retention space S. The value of the threshold is previously set and stored in the ROM 4002. If the prescribed application-performable number of sheets is ten, for example, this means that the application can be performed without filling the application liquid into the liquid retention space S, until the application liquid has been applied to ten application media in total. When the application liquid has been applied to five application media in total, that is, when the accumulated count stored in the RAM 4003 is five, the accumulated count is smaller than the prescribed application-performable number of sheets, ten. Thus, the application operation is continued. On the other hand, if the accumulated count is ten, the process returns to step S201, and the filling step is performed.

Although the maximum number of sheets considered as the number of the sheets to which the application can be carried out is defined as the "prescribed application-performable number of sheets" in this embodiment, the prescribed application-performable number of sheets is not limited to this. The number of sheets less than the above maximum number of sheets may be defined as the "prescribed application-performable number of sheets." Specifically, even if the maximum number of sheets considered as the number of the sheets to which the application can be carried out is ten, for example, the "prescribed application-performable number of sheets" may be set to seven, and, after the application liquid has been applied to seven sheets, the control to fill the application liquid into the liquid retention space S is carried out. With this design, even if the problem occurs that the amount of the liquid applied to the application media is larger than expected, it is possible to avoid such a situation that the application liquid is not applied to the application media.

Next, description will be given of an application-liquid collection operation as the postprocessing shown in step S209 with reference to FIG. 20. In this collection operation, the atmosphere communication valves 3005 and 3013 are opened to the atmosphere, and the pump 3007 is driven. This driving causes the application liquid in the tube 3012 of the first channel 3001, the liquid retention space S and the second channel 3002 to flow into the liquid storage tank 3003. This collection operation will be described in detail below.

Immediately before the start of the collection operation, the pump 3007 is stopped. At the same time, the atmosphere communication valve 3005 is opened, and the atmosphere communication port 3004 is therefore opened to the atmosphere.

Figure 20:
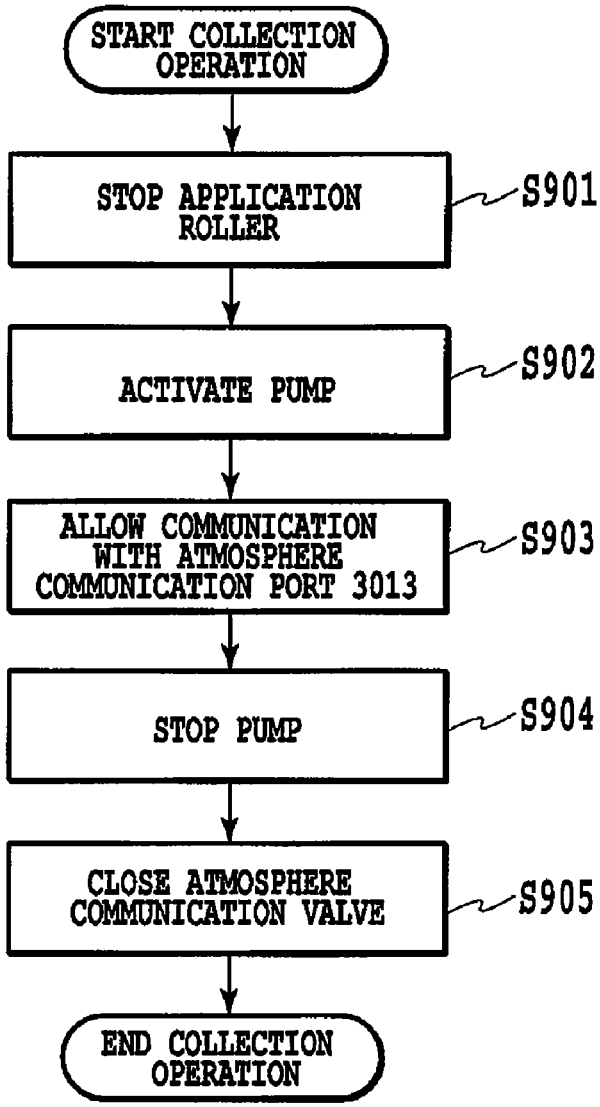
FIG. 20 is a flow chart showing a collection operation sequence.

Once the collection operation is started, the application roller 1001 is stopped in step S901 of FIG. 20. Subsequently, in step S902, the pump 3007 is activated to cause the application liquid to flow in the liquid channel 3000. The direction of the flow of the application liquid in the second channel 3002 is the direction indicated by the arrow in FIG. 11, for example.

In step S903, the three-way valve 3006 is set in a state shown in FIG. 14 to allow the atmosphere communication port 3013 and the liquid-retention-member side tube 3012 to communicate with each other. As a result, since the operation of the pump 3007 has caused the application liquid to flow in the direction indicated by the arrow in FIG. 11, air flows in from the atmosphere communication port 3013 as the application liquid flows. Then, the application liquid present in the passage (hereinafter also referred to as the liquid passage A) which runs from the liquid-retention-member side tube 3012 to the second channel 3002 and includes the liquid retention space S is collected to the storage tank 3003, and the liquid passage A is filled with air. Meanwhile, since the three-way valve 3006 is set in the state as shown in FIG. 14, the storage-tank side tube 3011 becomes separated from the atmosphere.

In step S904, the operation of the pump 3007 is stopped, and the second channel 3002 is separated from the atmosphere by the pump 3007. Finally, the atmosphere communication valve 3005 is closed in step S905.

With this configuration, since the application liquid is collected from the liquid passage A when the application operation is not performed for more than a predetermined period of time, the application liquid can be prevented from being volatilized and stuck in the liquid retention space S in the liquid passage A, even if the application operation is not performed for a long time. As a result, the application failure caused by the sticking of the application liquid to the contact member 2009 is prevented from occurring.

By carrying out the collection operation, the volatilization of the application liquid from the liquid retention space S can be reduced. After the collection operation, the atmosphere communication valve 3005 is closed, and the communication between the storage-tank side tube 3011 and the atmosphere communication port 3013 is blocked by switching the switching valve 3006, so that the storage tank 3003 is separated from the atmosphere. As a result, it is possible to reduce the volatilization of the application liquid out of the storage tank 3003. In addition, as described above, the application liquid in the liquid passage A communicating with the atmosphere is collected to the storage tank 3003, and the storage tank 3003 is also separated from the atmosphere. Accordingly, even if the device is inclined during carrying or transportation, the application liquid can be prevented from flowing out.

In this embodiment, a step of stopping the application roller 1001 may be provided between the steps S208 and S201.

In addition, although, in this embodiment, the information concerning the amount of the application liquid consumed during the application operation is acquired on the basis of the information indicating the number of the application media to which the liquid has been applied, the information is not limited to this. For example, the information concerning the consumption may be acquired on the basis of information indicating the size of the application media (to be described in a second embodiment), or information indicating the area of the part of the application media to which the application liquid is applied (to be described in a third embodiment). In addition, the information concerning the consumption may be acquired on the basis of information concerning the number of times the application roller rotates while the application to the application media is performed, information indicating the elapsed time during the application, or the like. Alternatively, a sensor may be provided to the liquid retention member, and the liquid level in the liquid retention space S may be detected by this sensor to acquire the information concerning the consumption of the application liquid. In other words, it suffices that the information concerning the amount of the application liquid consumed during the application operation can be acquired to control the filling operation using the pump.

This embodiment is applicable when a job is composed of a plurality of image data. Specifically, since, in this embodiment, the count value is cumulatively increased for each sheet, and the comparison between the accumulated count value and the prescribed application-performable number of sheets is performed for each sheet, it is therefore possible to appropriately determine whether or not the filling step of the application liquid has to be performed between two pages included in different jobs, as well as between two pages included in a job.

If it is determined that the next application medium would not be supplied after waiting for a predetermined period of time in step S207, the application liquid is collected to the storage tank 3003 in the postprocessing in step S209. Thereafter, once the next application start command is inputted, the application liquid is filled into the liquid retention space S in step S201, and the count in the RAM 4003 is reset in step S202. Accordingly, even if the interval between jobs is longer than a predetermined period of time, it is possible to appropriately make the determination as to whether or not a suitable amount of application liquid is retained in the liquid retention space S.

As described above, in the liquid application device according to this embodiment, when the application liquid is applied to the application media, the pump as the liquid moving means is activated only when necessary, and is stopped otherwise. Accordingly, compared to the case where the pump is always operated during the application, the noise and/or the power consumption due to the operation of the pump can be reduced.

In this embodiment, on the basis of the information concerning the consumption of the application liquid, the pump is driven and the process in which the application liquid is filled into the liquid retention space S is carried out. However, the actual purpose here is to refill the liquid retention space S with the application liquid in order to enable the application roller to perform application. Accordingly, even if the liquid retention space S is not completely filled with the application liquid, the purpose is achieved when the application liquid is supplied to the liquid retention space S. In other words, an embodiment can be adopted in which the liquid retention space is refilled with the application liquid to the extent that air remains in part of the liquid retention space, and the filling process is therefore not necessary. As described above, this embodiment includes an embodiment in which the application liquid is supplied to the extent that air remains in part of the liquid retention space, as well as the embodiment in which the application liquid is supplied to the extent that the liquid retention space S is completely filled with the application liquid (the embodiment including the filling process). In addition, in this embodiment, the application-liquid supply operation to the liquid retention space is controlled on the basis of the information concerning the consumption of the application liquid.

Also in the second embodiment, the third embodiment, a fourth embodiment and a fifth embodiment, which are described below, those involving the filling process will be described by way of examples. However, the fact that the present invention is not limited to the embodiment involving the filling process holds true also for the embodiments described below.

Second Embodiment

In this embodiment, the information concerning the amount of the application liquid consumed during the application operation is acquired on the basis of the information indicating the size of the application media.

Figure 21:
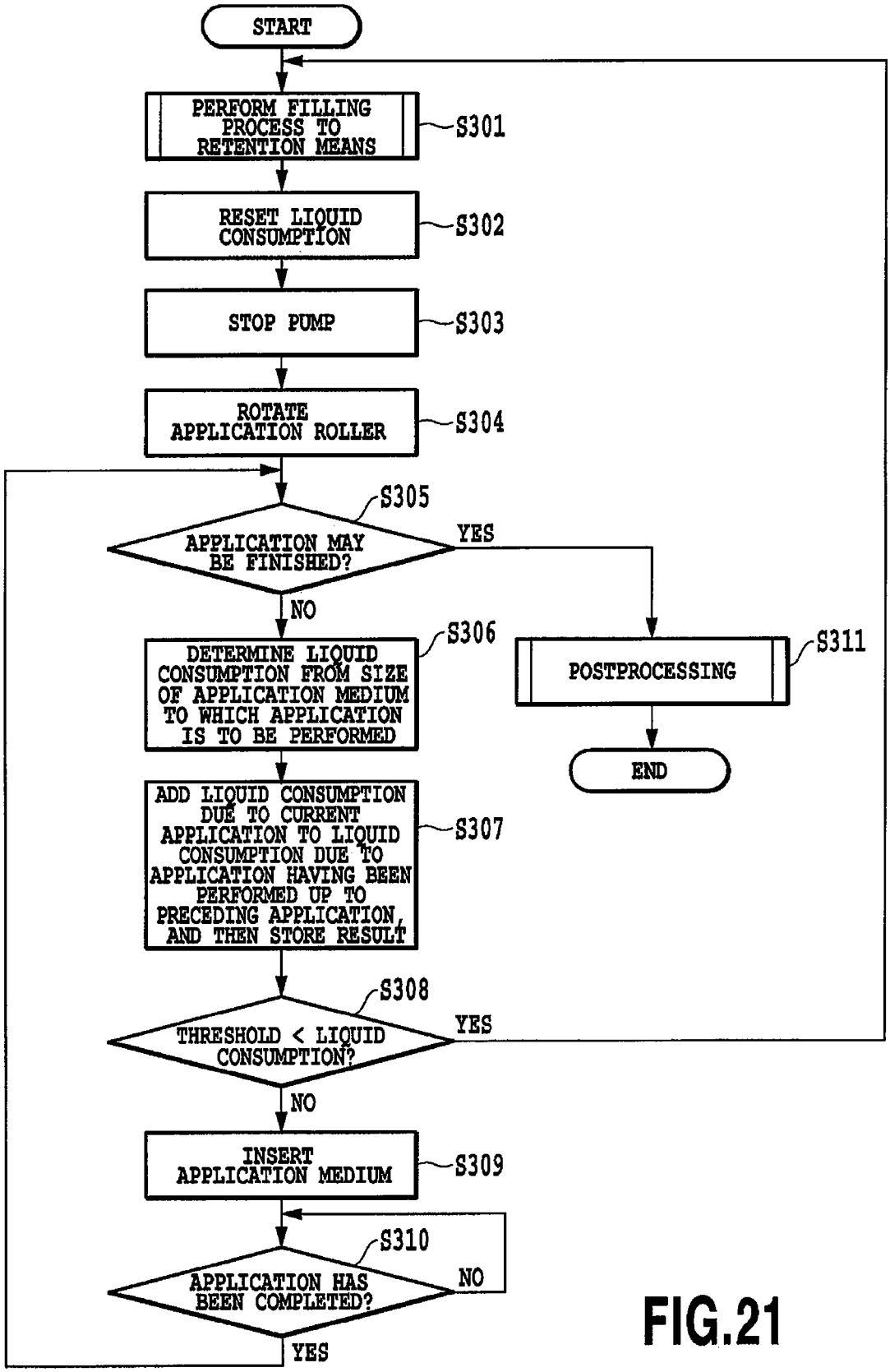
FIG. 21 is a flow chart showing a liquid-application operation sequence in an embodiment of the present invention.

FIG. 21 is a flow chart showing a procedure relating to the liquid application by the liquid application device of the present embodiment. Description will be given below of each step relating to the liquid application with reference to this flow chart. Once the liquid application device is turned on, the control unit 4000 carries out the following application operation sequence in accordance with the flow chart shown in FIG. 21.

In steps S301 to S304, the same processes as those in steps S201 to S204 described in connection with the first embodiment are performed, and the description thereof will therefore be omitted.

In step S305, the determination as to whether or not the application operation may be finished, is made. The determination as to whether or not the application may be finished in this step is made on the basis of a detection signal from a sensor provided upstream of the application roller 1001 and the counter roller 1002. If the detection signal is sent from the sensor in a predetermined period of time, that is, if the next application medium is being fed, it is determined that the application is not completed, and the process proceeds to step S306. On the other hand, if the detection signal is not sent from the sensor in the predetermined period of time, that is, if the next application medium is not being fed, it is determined that the application has been completed, and the process proceeds to step S311 to perform postprocessing.

The determination as to whether or not the application step may be finished in this step is not limited to that described above. Any means can be used to make the determination, as long as the means can be used to determine whether or not the next application operation has to be performed; for example, an embodiment may be adopted in which the determination is made on the basis of an application start command including information specifying the number of the application media to which the liquid is to be applied.

In step S306, the size of the application medium to which the application liquid is to be applied next is detected by the size detecting sensor provided upstream of the application roller 1001 and the counter roller 1002. Then, on the basis of the information indicating the detected size, the information concerning the amount of the application liquid (hereinafter referred to as the liquid consumption) required for this size of the application medium to which the application liquid is to be applied next is acquired.

An example of the information concerning the liquid consumption is shown in FIG. 22. Definition is given in such a way that, when the application liquid is applied to an A3 sheet, the liquid consumption is 8, and, when an A4 sheet, the liquid consumption is 4, for example. Specifically, with reference to the table defined as shown in FIG. 22, the information concerning the liquid consumption relating to the size of the application medium to which the application liquid is applied next is acquired on the basis of the information indicating the size sent from the size detecting sensor.

Although, in this embodiment, the consumption of the liquid is defined as shown in FIG. 22 by way of an example, the amount of the application liquid required in one application varies depending on various conditions, such as compositions of the application liquid, liquid absorption characteristics of the application medium, and the environment during application (temperature and humidity). Thus, it is desirable to associate the most appropriate consumption of liquid with these conditions in advance.

Subsequently, in step S307, the information concerning the liquid consumption due to the current application acquired in step S306 is added to the information concerning the liquid consumption due to the application having been performed up to the preceding application, which information is stored in the RAM 4003. Then, the information concerning the total liquid consumption is stored in the RAM 4003.

In step S308, the determination as to whether or not the application liquid should be filled into the liquid retention space S, is made. In this step, the comparison between the threshold to indicate the necessity of filling the application liquid into the liquid retention space S and the information concerning the total (accumulative) liquid consumption is made, the threshold being previously set and stored in the ROM 4002, and the information being stored in the RAM 4003. If the information concerning the total liquid consumption is larger than the threshold, it is determined that the application liquid has to be filled into the liquid retention space S, and the process returns to step S301. In step S301, by driving the pump 3007 and thus circulating the application liquid as described above, the filling operation is again performed to the liquid retention space S. If the information concerning the total liquid consumption is smaller than the threshold, it is determined that there is no need to carry out the filling of the application liquid, and the process proceeds to step S309.

With regard to the determination in this step, description will be given of a case where the threshold is set to 16, for example, as the condition for performing application in a state where the application liquid is not circulated. In this case, if the application is performed to an A3 sheet, an A4 sheet and a B5 sheet, for example, the total liquid consumption becomes 8+4+3=15, on the basis of FIG. 22. Thereafter, when it is attempted to apply the application liquid to an A5 sheet, the total liquid consumption becomes 15+2=17, resulting in the condition, "the threshold (16)"<"the information concerning the liquid consumption (17)." As a result, there arises the necessity to perform the filling process to the liquid retention member before the application to the A5 sheet is performed. When it is determined that the information concerning the liquid consumption becomes larger than the threshold in this way, the process proceeds to step S301 to perform the filling process.

In step S309, the application medium feeding mechanism 1006 transfers an application medium to the interface between the application roller 1001 and the counter roller 1002, allowing the application medium to be inserted between these rollers. The inserted application medium is then transferred toward the sheet discharging unit as the application roller 1001 and the counter roller 1002 rotate. This step allows the application liquid to be applied to the application medium as described in connection with the first embodiment.

After the application operation to the application medium is performed as described above, the determination as to whether or not the application to the application medium has been completed, is made (step S310). If it is determined that the application is not completed, this step is repeated to repeat the application operation until the application to the application medium is performed all over the part to which the application is required. If it is determined that the application to the application medium has been completed in step S310, the process proceeds to step S305, and the determination as to whether or not the application operation may be finished is made. The steps S305 to S309 are repeated until it is determined that the application operation may be finished.

In step S311, the postprocessing described in connection with FIG. 20 is performed, and this process is finished.

As described above, in the liquid application device according to this embodiment, when the application liquid is applied to the application media, the pump as the liquid moving means is activated only when necessary, and is stopped otherwise. Accordingly, compared to the case where the pump is always operated during the application, the noise and/or the power consumption due to the operation of the pump can be reduced.

Third Embodiment

Although, in the first and second embodiments, the application liquid is filled into the liquid retention space S after the application operation has been completed, in this description of this embodiment, the filling of the application liquid is performed during the application operation.

In this embodiment, the information concerning the amount of the application liquid consumed during the application operation is acquired on the basis of the information indicating the area of the part of the application media to which the application liquid is applied. The application area on the application media can be derived from the area and the number of rotations of the application roller. Since the area of the application roller can be set in advance, the determination of the application area of the application liquid is made on the basis of the number of rotations of the application roller in this embodiment.

Figure 23:
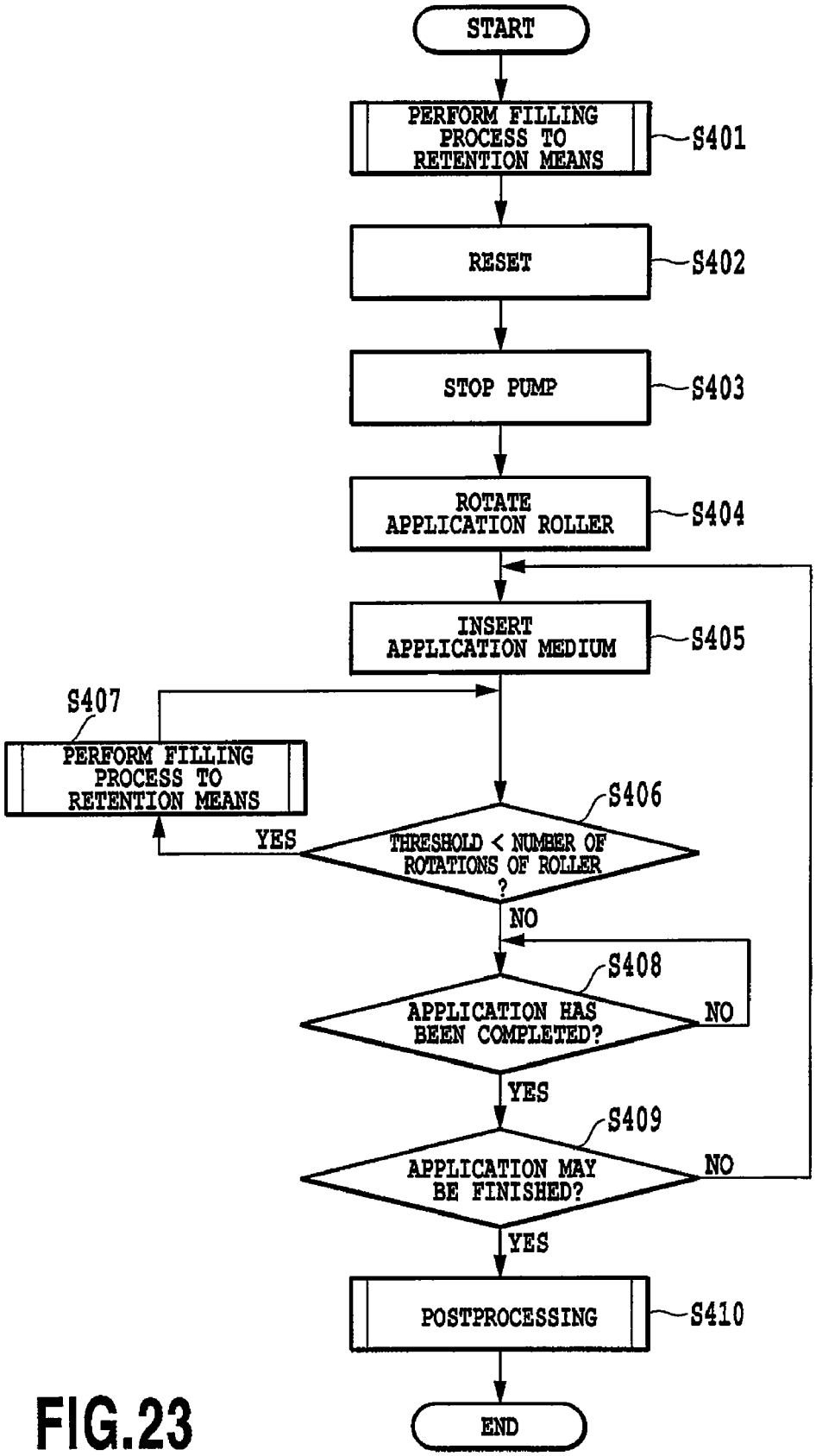
FIG. 23 is a flow chart showing a liquid-application operation sequence in an embodiment of the present invention.

FIG. 23 is a flow chart showing a procedure relating to the liquid application by the liquid application device of this embodiment. Description will be given below of each step relating to the liquid application with reference to this flow chart. Once the liquid application device is turned on, the control unit 4000 carries out the following application operation sequence in accordance with the flow chart shown in FIG. 23.

In steps S401 to S404, the same processes as those in steps S201 to S204 described in connection with the first embodiment are performed, and the description thereof will be omitted.

Subsequently, as in the case of the first embodiment, the application medium feeding mechanism 1006 transfers an application medium to the interface between the application roller 1001 and the counter roller 1002, allowing the application medium to be inserted between these rollers. The inserted application medium is then transferred toward the delivery unit as the application roller 1001 and the counter roller 1002 rotate (step S405). At this time, when the transferred application medium is detected by the sensor provided upstream of the application roller 1001 and the counter roller 1002, the number of rotations of the application roller 1001 is counted. This count is constantly added (incremented), and the accumulated count value is stored in the RAM 4003.

In step S406, the determination as to whether or not the application liquid should be filled into the liquid retention space S, is made. In this step, the comparison between the threshold to indicate the necessity of filling the application liquid into the liquid retention space S and the accumulated count value of the number of rotations of the application roller, is made, the threshold being previously set and stored in the ROM 4002, and the accumulated count value being stored in the RAM 4003. If the accumulated count value is larger than the threshold, it is determined that the application liquid has to be filled into the liquid retention space S, and the process proceeds to step S407. As described above, if it is determined that the application liquid has to be filled into the liquid retention space S in this step, although the application operation is being performed, the filling of the application liquid is carried out. If the accumulated count value is smaller than the threshold, it is determined that there is no need to carry out the filling of the application liquid, and the process proceeds to step S408.

In step S407, the pump 3007 is driven to fill the application liquid into the liquid retention space S from the storage tank 3003. Simultaneously with the filling, the accumulated count value of the number of rotations of the application roller, which is stored in the RAM 4003, is reset to zero. Once the filling is completed by allowing the pump 3007 to rotate for a predetermined period of time, the driving of the pump 3007 is stopped. During the filling in this step, the rotation of the application roller 1001 may be either maintained or stopped. In this way, in this step, it is possible to refill the liquid retention space S with the application liquid by the amount corresponding to the amount of the application liquid applied by the application roller 1001.

In step S408, the determination as to whether or not the application to the application medium has been completed, is made. If the application is not completed, the application operation is repeated until the application to the application medium is performed all over the part to which the application is required.

After the application operation to the application medium has been completed as described above, the determination as to whether or not the application step may be finished is made in step S409. The determination as to whether or not the application may be finished in this step is made on the basis of a detection signal from the sensor (or another sensor than the above sensor, which is also provided upstream of the application roller 1001 and the counter roller 1002). If the detection signal is sent from the sensor in a predetermined period of time, that is, if the next application medium is being fed, it is determined that the application is not completed. In this case, the counting of the number of rotations of the application roller is stopped, and the process proceeds to step S405. On the other hand, if the detection signal is not sent from the sensor in the predetermined period of time, it is determined that the application may be finished, and the process proceeds to step S410 to perform postprocessing.

In step S410, the postprocessing described in connection with FIG. 20 is performed, and this process is finished.

As described above, in this embodiment, the information concerning the amount of the application liquid consumed during the application operation is acquired, and the filling of the application liquid is performed on the basis of the acquired information, so that the filling of the application liquid can be performed more properly. Accordingly, this embodiment is particularly effective when the size of the application media is particularly large, or when the application liquid is applied to rolled paper or the like. In the liquid application device according to this embodiment, when the application liquid is applied to the application media, the pump as the liquid moving means is stopped until the information concerning the liquid consumption becomes larger than the threshold. Accordingly, the noise generation and/or the power consumption due to the operation of the pump during the application of the application liquid to the application media can be minimized.

In this embodiment, in determining the application-liquid applied area, the number of rotations of the application roller is used. However, the present invention is not limited to this. For example, the application-liquid applied area can be derived from the elapsed time of the application operation, the speed of rotation (the angular speed) of the application roller, and the longitudinal length of the application roller. Since the speed of rotation of the application roller, and the longitudinal length of the application roller can be set in advance, the determination of the application-liquid applied area may be made by using the elapsed time.

The determination as to whether or not the filling of the application liquid has to be performed is not limited to that made on the basis of the area of the part of the application media to which the application liquid is applied. The consumption of the application liquid in the liquid retention space S may be constantly monitored during the application operation so as to perform the filling of the application liquid according to the result of the monitoring. Such monitoring can be performed by detecting the liquid level of the application liquid in the liquid retention space S via the sensor provided in the liquid retention member 2001.

Fourth Embodiment

Although the threshold for determining the condition under which the application can be performed may be a constant value, since the viscosity of the application liquid varies depending on the environmental temperature of the liquid retention member (the liquid retention space) (hereinafter referred to also simply as the environmental temperature), the amount of the application liquid applied to the application media also varies correspondingly. For example, the application amount becomes large in a low-temperature environment as compared to that in a normal-temperature environment, and it becomes small in a high-temperature environment as compared to that in a normal temperature. Therefore, the threshold may be changed according to the environmental temperature.

If the threshold is changed according to the environmental temperature, a temperature sensor as means for measuring the environmental temperature is provided in the liquid application device, and the threshold is set on the basis of a detection signal from the temperature sensor. In order to make the threshold more correctly reflect the physical properties relating to the application amount of application liquid, such as viscosity, it is preferable to provide the temperature sensor directly in the liquid retention member.

Figure 24:
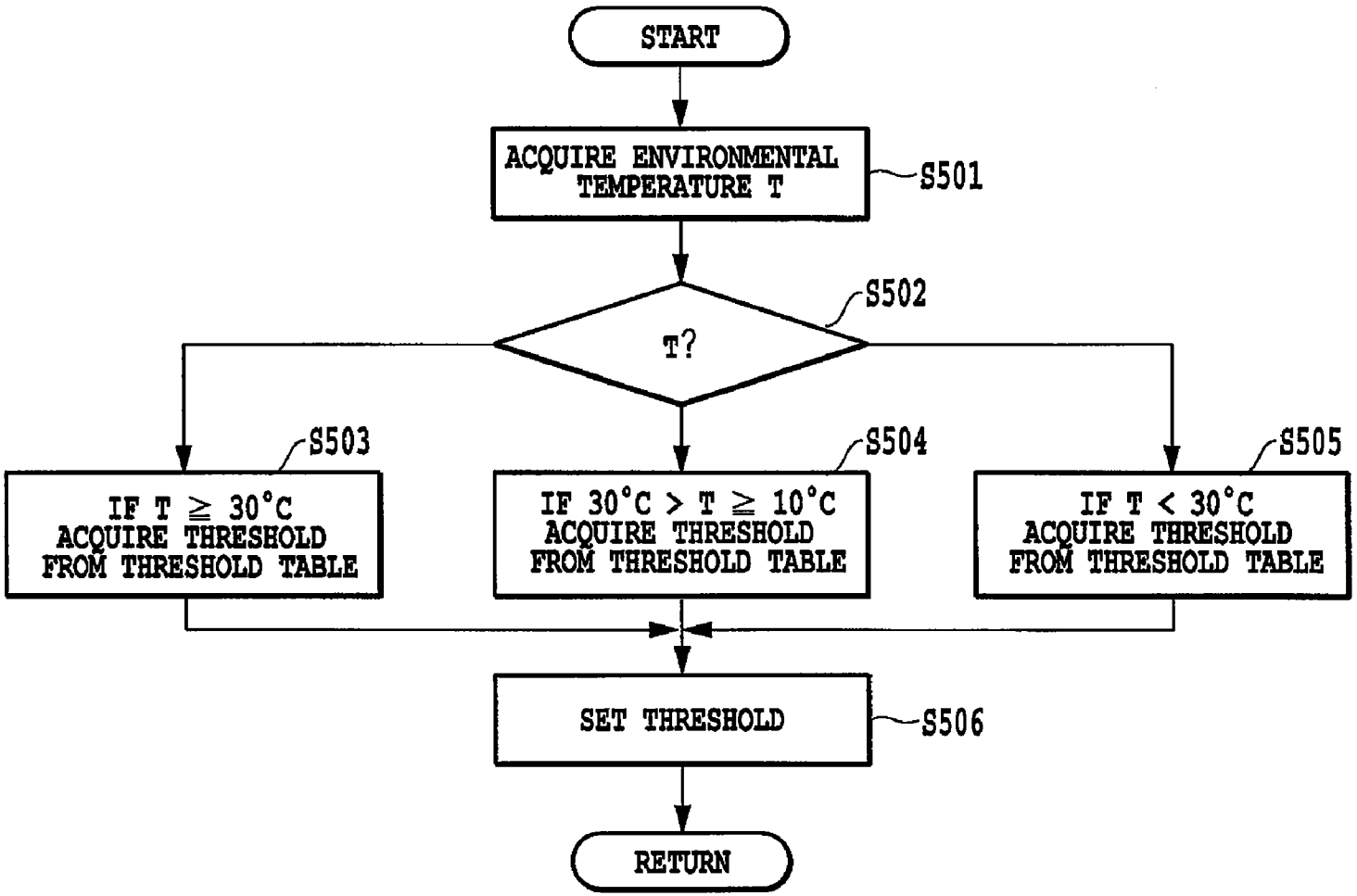
FIG. 24 is a flow chart in accordance with which a threshold is determined when a liquid application operation in an embodiment of the present invention is performed.

FIG. 24 is a flow chart showing a procedure relating to the threshold determination of the present embodiment. The control unit 4000 carries out the following threshold determination sequence in accordance with the flow chart shown in FIG. 24.

In step S501, the environmental temperature T is obtained by the temperature sensor. Subsequently, in step S502, determined is the temperature range which the environmental temperature is in. If 30° C.≦the determined environmental temperature T, the process proceeds to step S503; if 10° C.≦the environmental temperature T<30° C., the process proceeds to step S504; and if the environmental temperature T<10° C., the process proceeds to step S505. Then, a threshold corresponding to the environmental temperature is acquired from Threshold Table. An example of the Threshold Table is shown in FIG. 25. Subsequently, the process proceeds to step S506 to set the threshold corresponding to the environmental temperature on the basis of the threshold acquired in one of steps S503 to S505. Thereafter, the thus set threshold and the information concerning the consumption of the application liquid described in connection with the first to third embodiments are compared to control whether or not the pump performs the filling operation.

As described above, with this embodiment, it is made possible to set a suitable threshold corresponding to the environmental temperature.

It should be note that the relationship between the environmental temperatures and the corresponding thresholds shown in FIG. 25 is merely an example, and the number of temperature-range divisions and the respective temperature ranges divided may be set as desired. In addition, since the corresponding thresholds vary depending on the properties of the applied material, the threshold may be appropriately set according to the material for the application liquid.

Fifth Embodiment

In the above embodiments, the intermittent supply operation of the liquid from the storage tank to liquid retention space S is performed on the basis of the information concerning the consumption of the application liquid. However, the present invention is not limited to the above embodiment. It suffices that said liquid supply operation (the filling step) is performed before the amount of the application liquid present in the liquid retention space S becomes equal to or less than a predetermined amount (before the application liquid has run out, for example), as will be described in connection with this embodiment.

in this case, the start control of said intermittent liquid supply operation is performed before the liquid retained in the liquid retention space has run out, and the stop control of said intermittent liquid supply operation is performed after said intermittent liquid supply operation was continued for predetermined time, or after the amount of liquid in the liquid retention space S reaches the specified amount.

For example, a sensor for detecting the liquid level in the liquid retention space S may be provided so that, when the liquid level lower than a predetermined level is detected by the sensor, the step of filling the application liquid into the liquid retention space S is performed. In other words, the liquid-level detection sensor may be used to detect the amount of the application liquid remaining in the liquid retention space S so that the filling step is performed before the application liquid in the liquid retention space S has run out.

The filling step may be performed every time the printing of a print job is completed regardless of the number of the application media which the print job involves in the output. If the filling step is performed in this way, it is possible to fill the application liquid into the liquid retention space S before the application liquid has run out.

At this time, in order to prevent the application liquid in the retention space S from running out until the printing of a print job is completed, it is effective to set the volume of the liquid retention space S sufficiently large. The amount of the application liquid required to carry out the application to one hundred recording media, for example, is roughly known. Accordingly, it is desirable to set the volume of the liquid retention space S so that the maximum conceivable number of the sheets for recording can be covered.

Nevertheless, in a case where the number of the sheets which a print job involves in the output is very large, the application liquid in the liquid retention space S can run out before the printing of the print job is completed. In this case, before the start of the application operation, the determination as to whether or not the number of the sheets to be output exceeds the maximum conceivable number of sheets is made on the basis of the information concerning the number of sheets included in the print job. If the number of the sheets to be output exceeds the maximum conceivable number of sheets, it suffices that before all print of the print job has been completed, the filling step is performed an appropriate number of times every time the application to the maximum number of sheets is completed, or every predetermined period of time for application, for example. If the filling step is performed in this way, it is possible to perform the filling of the application liquid before the application liquid in the liquid retention space S has run out. It should be noted that, in the comparison concerning the number of the sheets for output, the determination is not limited to that as to whether or not the number of the sheets for output exceeds the maximum number of sheets. The compared number may be arbitrary as long as the compared number is less than the maximum number of sheets. Also in this case, a predetermined amount of application liquid remains in the liquid retention space S. Accordingly, the filling step can be performed before the amount of the application liquid present in the liquid retention space S becomes less than a predetermined amount (before the application liquid has run out).

Another Embodiment

The liquid application devices shown in the first to fifth embodiments are effective when applied to inkjet recording apparatuses. Description will be given below of the case where the liquid application device described above is applied to an inkjet recording apparatus. However, since the application operation control described in connection with the first to fourth embodiments is applied similarly, the description thereof will be omitted.

Figure 26:
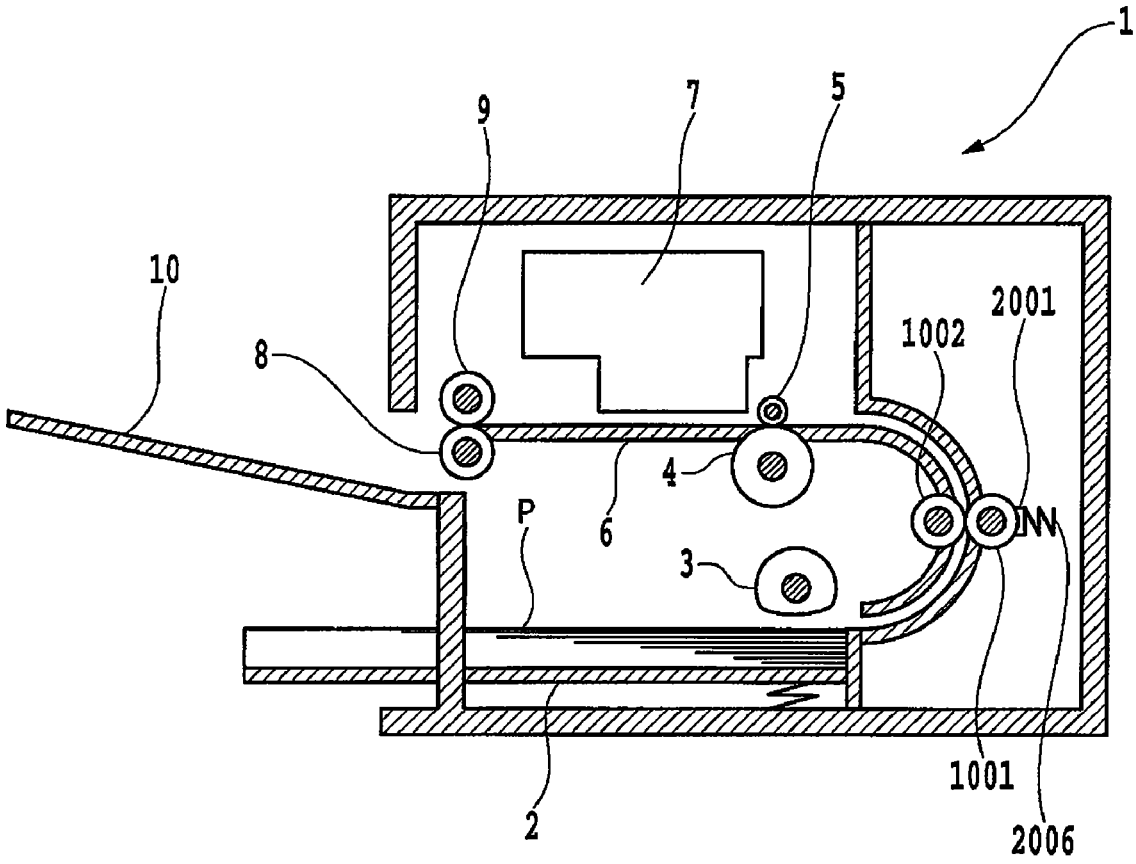
FIG. 26 is a longitudinal sectional side view showing a schematic configuration of an inkjet recording apparatus in an embodiment of the present invention.

FIG. 26 is a diagram showing a schematic configuration of the inkjet recording apparatus 1 including the application mechanism having almost the same configuration as that of the above liquid application device.

In the inkjet recording apparatus 1, provided is a feed tray 2 on which a plurality of recording media P are stacked, and a semi lunar shaped separation roller 3 separates the recording media P stacked on the feed tray one by one, and feeds each medium to a transfer path. In the transfer path, the application roller 1001 and the counter roller 1002 constituting the liquid application means of the liquid application mechanism are disposed. The recording medium P fed from the feed tray 2 is transferred to the interface between the rollers 1001 and 1002. The application roller 1001 is caused to rotate clockwise in FIG. 26 by the rotation of the roller drive motor, and applies the application liquid on the recording surface of the recording medium P while transferring the recording medium P. The recording medium P to which the application liquid has been applied is sent to the interface between a transfer roller 4 and a pinch roller 5. Subsequently, the counterclockwise (in this figure) rotation of the transfer roller 4 transfers the recording medium P on a platen 6, and moves the medium to a position facing a recording head 7 being an element of recording means. The recording head 7 is an inkjet recording head in which the predetermined number of nozzles for ejecting ink are arranged. While the recording head 7 scans the recording surface in a direction perpendicular to the plane of the drawing sheet, ink droplets are ejected from the nozzles to the recording surface of the recording medium P in accordance with the recorded data to perform recording. An image is formed on the recording medium while the recording operation and the transfer operation by a predetermined feed carried out by the transfer roller 4 are alternately repeated. With the image forming operation, the recording medium P is held between a sheet discharging roller 8 and a sheet discharging spur roller 9 provided downstream of the scanning region of the recording head in the transfer path of the recording media, and is discharged onto a sheet discharged tray 10 by the rotation of the sheet discharging roller 8.

As the inkjet recording apparatus, a so-called full-line type inkjet recording apparatus can be constructed, which performs the recording operation by using a long recording head which has ink-discharging nozzles arranged across the maximum width of the recording media.

The application liquid used in this embodiment is a treatment liquid for promoting the coagulation of pigment when the recording is carried out using an ink which contains pigment as a coloring material.

With regard to this embodiment, the treatment liquid is used as the application liquid, so that the treatment liquid is allowed to react with the pigment as a coloring material in the ink ejected to the recording medium, to which the treatment liquid has been applied, to promote the coagulation of pigment. By promoting the coagulation of pigment, it is made possible to achieve the improvement of the recording density. In addition, it is also made possible to reduce or prevent bleeding. Needless to say, the application liquid used in the inkjet recording apparatus is not limited to the above example.

Figure 27:
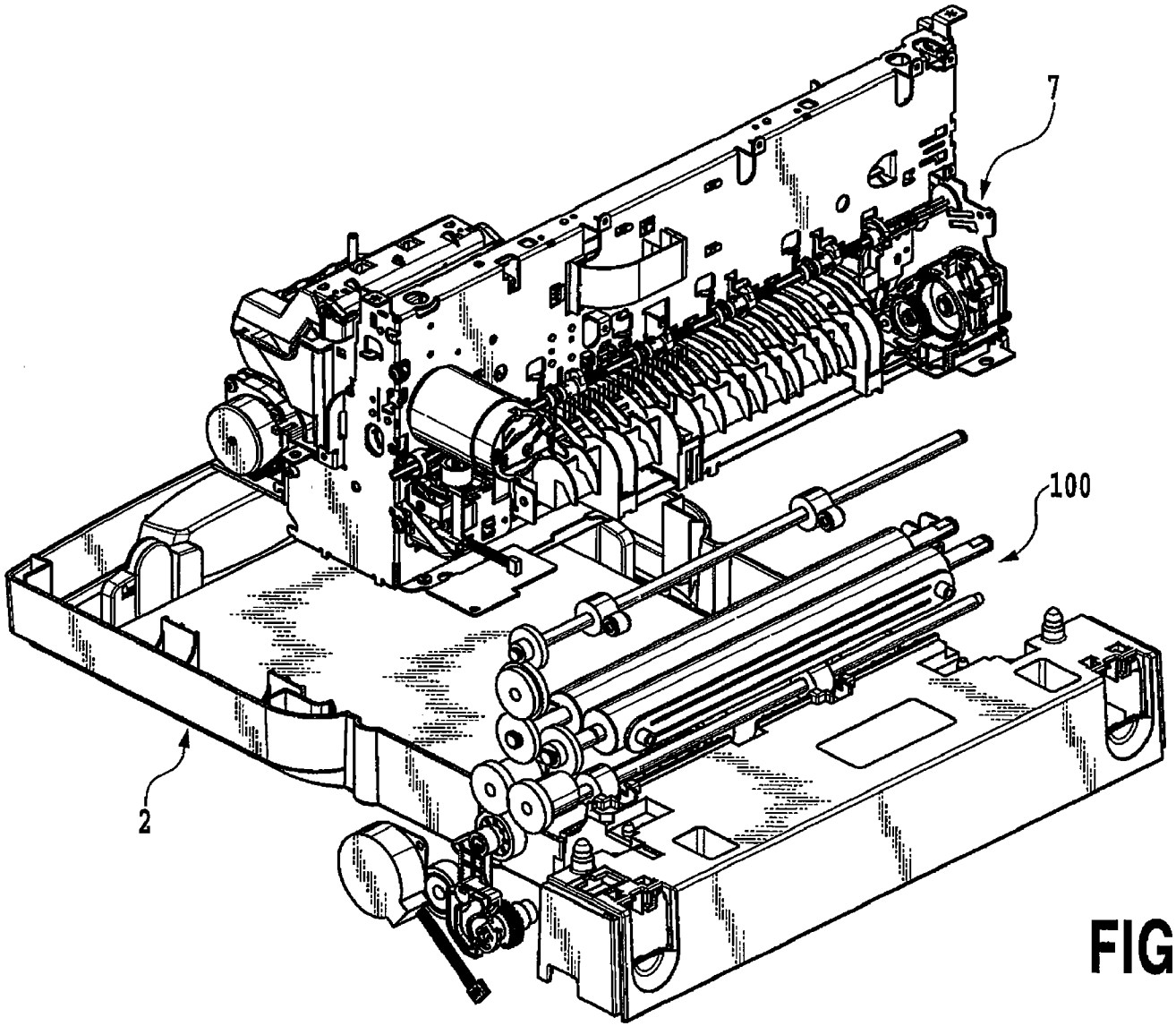
FIG. 27 is a perspective view showing a main part of the inkjet recording apparatus shown in FIG. 26.

FIG. 27 is a perspective view showing a main part of the above-described inkjet recording apparatus. As shown in this figure, an application mechanism 100 is provided above an edge of the feed tray 2, and the recording means including the recording head 7 is provided above the application mechanism and over a middle portion of the feed tray 2.

Figure 28:
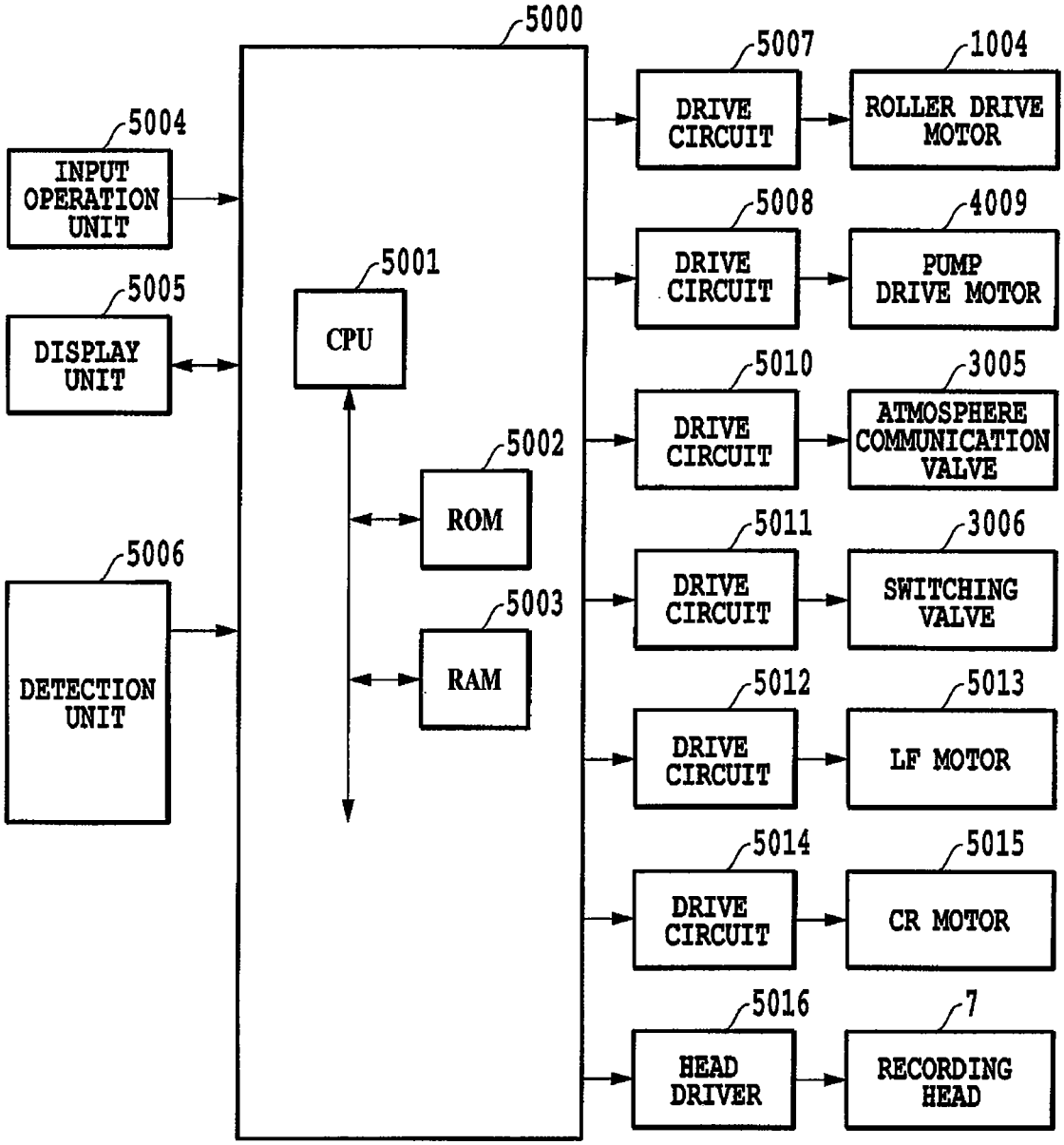
FIG. 28 is a block diagram showing a schematic configuration of a control system of the inkjet recording apparatus shown in FIG. 26.

FIG. 28 is a block diagram showing a control system of the above-described inkjet recording apparatus. In this figure, the roller drive motor 1004, the pump drive motor 4009, and the atmosphere communication valve 3005, which are elements of the liquid application mechanism, are the same elements as those described in connection with the above liquid application device.

A CPU 5001 controls the driving of each element of the application mechanism in accordance with the program of a procedure described later in connection with FIG. 29. The CPU 5001 also controls the driving of an LF motor 5013, a CR motor 5015 and the recording head 7, which are included in the recording means, via drive circuits 5012, 5014 and 5016, respectively. Specifically, the transfer roller 4, for example, is rotated by the driving of the LF motor 5013, and a carriage on which the recording head 7 is mounted is moved by the driving of the CR motor. The CPU 5001 also effects control of the ink discharge from the nozzles of the recording head.

Figure 29:
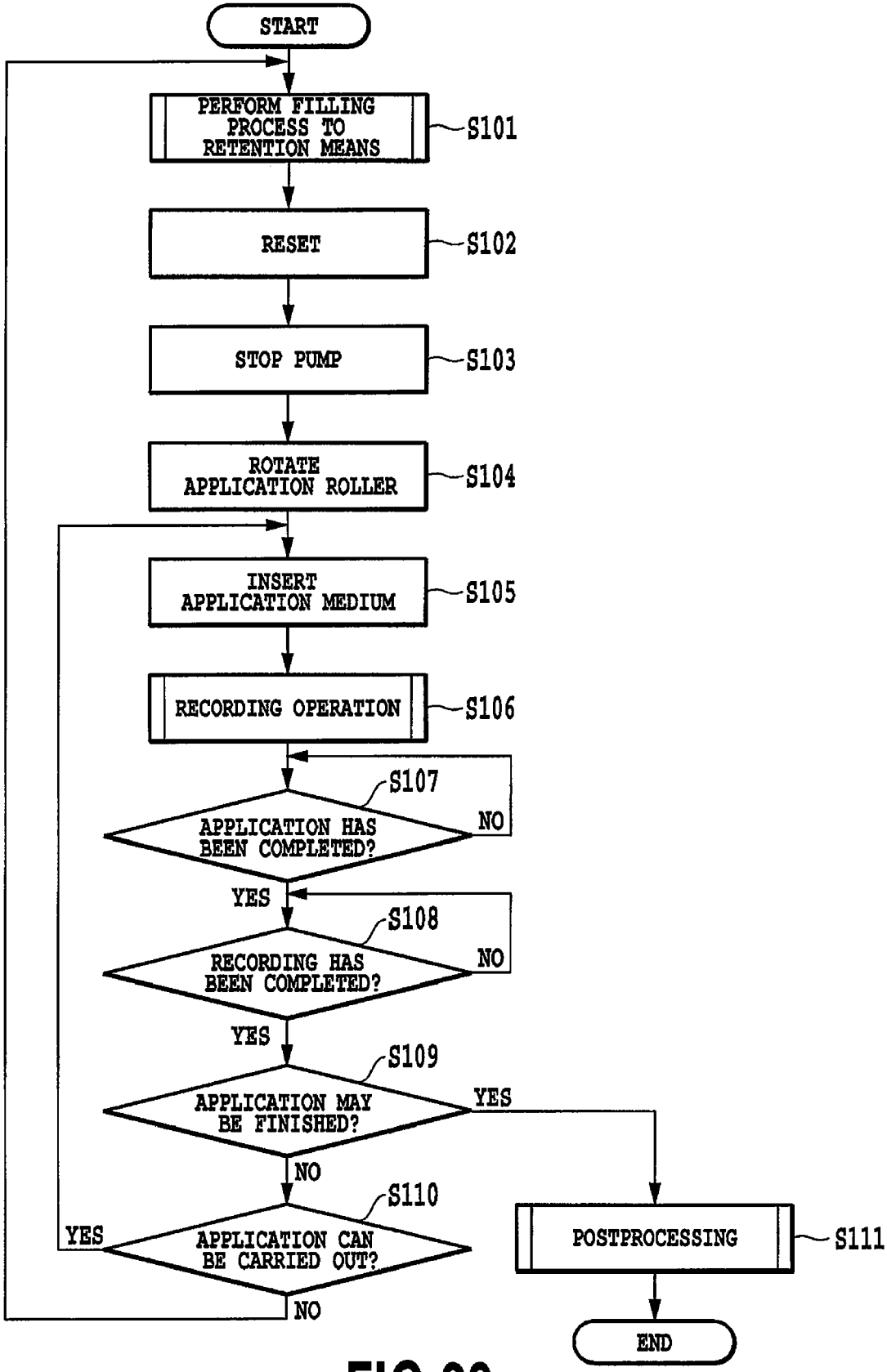
FIG. 29 is a flow chart showing a sequence of a liquid application operation and a recording operation performed with the inkjet recording apparatus shown in FIG. 26.

FIG. 29 is a flow chart showing a procedure of the liquid application operation and the accompanying recording operation using the inkjet recording apparatus of this embodiment. In this figure, the processes in steps S101 to S105, step S107, and steps S109 to Sill are the same as those in steps S201 to S205, and steps S206 to S209, respectively, shown in FIG. 16.

As shown in FIG. 29, in this embodiment, when a command to start the recording is received, the application liquid is filled into the liquid retention space S, the operation of the pump is stopped, and a series of steps for liquid application are performed (steps S101 to S105). After these application steps, performed is the recording operation onto the recording medium to which the application liquid has been applied over the part to which the application is required (step S106). Specifically, the recording head 7 is allowed to scan the recording medium P which is fed by a predetermined amount each time by the transfer roller 4, and ink is ejected from the nozzles in accordance with the recorded data during this scanning, so that the ink is allowed to stick to the recording medium to form dots. Since this sticking ink reacts with the application liquid, it is made possible to improve density and to prevent bleeding. Recording onto the recording medium P is performed by repeating the transfer of the recording medium and the scanning of the recording head. Subsequently, the determination as to whether or not the application of the application liquid has been completed is made (step S107), and the determination as to whether or not the recording operation has been completed is made (step S108). The recording medium onto which the recording has been completed is delivered onto the sheet discharging tray 10.

In this embodiment, with the liquid being applied to a recording medium, the recording is performed successively onto the part of the recording medium to which the application has been completed. Specifically, with regard to this embodiment, the length of the transfer path from the application roller to the recording head is less than that of the recording medium, and, when the part of the recording medium to which the liquid has been applied reaches the scanning region of the recording head, the application to other part of the recording medium is performed by the application mechanism. The liquid application and the recording are successively performed in different parts of the recording medium every time the recording medium is fed by a predetermined amount. However, when the present invention is applied to recording apparatuses, another mode can be an apparatus which performs recording onto a recording medium after application to the recording medium has been completed, as described in Japanese Patent Application Laid-open No. 2002-96452.

If it is determined that the recording has been completed in step S108, the determination as to whether or not the application may be finished in step S109 is made. If it is determined that the application may be finished, the process proceeds to step S111 to perform postprocessing, and this process is finished. If it is determined that the application has not been finished, the process proceeds to step S110.

In step S110, the determination as to whether or not the application can be carried out is made. If it is determined that the application can be carried out, the process returns to step S105, and the next application is started. If it is determined that the application cannot be carried out, the process returns to step S101, and the application liquid is filled into the liquid retention space S.

Although, in the above embodiment, the description has been given of an example in which the liquid is applied using the inkjet-type recording apparatus, the present invention is applicable to a recording apparatus of another type. For example, by using a liquid containing a fluorescent brightening agent as the application liquid, it is possible to improve the brightness of the media. The recording means used after the liquid application is not limited to that of the inkjet type. The effects can be obtained also by adopting other recording types, such as the thermal-transfer type and the electrophotographic type. In addition, as the application liquid, a sensitizer may be applied before recording in a recording apparatus of the silver-halide photographic type.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications as fall within the true spirit of the invention.

This application claims priority from Japanese Patent Application No. 2005-033538 filed Feb. 9, 2005, which is hereby incorporated by reference herein.

What is claimed is:

1. An inkjet recording apparatus comprising:

liquid application means comprising an application roller for applying a liquid that reacts with an ink to a medium and a retention member that retains the liquid to be applied by the application roller, wherein the liquid application means applies the liquid retained in the retention member to the medium via the application roller by rotating the application roller;

an inkjet head for ejecting the ink to the medium to which the liquid has been applied by the liquid application means;

storage means for storing the liquid;

a first passage for conveying the liquid from the storage means to the retention member;

a second passage for conveying the liquid from the retention member to the storage means;

a pump for causing the liquid to flow in a channel including the first passage, the retention member, the second passage and the storage means;

driving control means for controlling driving of the pump;

first determination means for determining whether or not a liquid application operation by the liquid application means is to be continued; and second determination means for determining whether or not a value concerning a liquid consumption by the liquid application operation is greater than a threshold, when the first determination means determines that the liquid application operation is to be continued, wherein, the driving control means drives the pump to convey the liquid from the storage means to the retention member through the first passage when the second determination means determines that the value concerning the liquid consumption is greater than the threshold, and does not drive the pump when the second determination means determines that the value concerning the liquid consumption is not greater than the threshold.

2. An inkjet recording apparatus comprising:

liquid application means comprising an application member for applying a liquid to a medium and a retention member for retaining the liquid to be applied by the application member, wherein the liquid application means applies the liquid retained in the retention member to the medium via the application member by rotating the application member;

an inkjet head for ejecting an ink to the medium to which the liquid has been applied by the liquid application means;

storage means for storing the liquid;

supply means for intermittently supplying the liquid from the storage means to the retention member;

first determination means for determining whether or not a liquid application operation by the liquid application means is to be continued;

second determination means for determining whether or not a value concerning a liquid consumption by the liquid application operation is greater than a threshold; and third determination means for determining whether or not a supply operation of the liquid by the supply means is to be performed, on the basis of results determined by the first and second determination means, wherein the third determination means determines that the supply operation is to be performed when the first determination means determines that the liquid application operation is to be continued and the second determination means determines that the value concerning the liquid consumption is greater than the threshold, and the third determination means determines that the supply operation is not to be performed when the first determination means determines that the liquid application operation is to be continued and the second determination means determines that the value concerning the liquid consumption is not greater than the threshold.

3. The inkjet recording apparatus according to claim 2, wherein the liquid contains a component that reacts with the ink.

4. The inkjet recording apparatus according to claim 2, wherein the value concerning the liquid consumption is a value indicating the number of sheets of the media to which the liquid has been applied by the liquid application means.

* * * * *